US006954187B2

(12) United States Patent
Mizobata et al.

(10) Patent No.: US 6,954,187 B2
(45) Date of Patent: Oct. 11, 2005

(54) METHOD FOR DRIVING ADDRESS-DISPLAY SEPARATED TYPE AC PLASMA DISPLAY PANEL AND DRIVING DEVICE USING SAME

(75) Inventors: Eishi Mizobata, Tokyo (JP); Tadashi Nakamura, Tokyo (JP); Yoshito Tanaka, Tokyo (JP); Manabu Fujiwara, Tokyo (JP)

(73) Assignee: NEC Plasma Display Corporation, Tokyo (JP)

( * ) Notice: Subject to any disclaimer, the term of this patent is extended or adjusted under 35 U.S.C. 154(b) by 0 days.

(21) Appl. No.: 10/937,576

(22) Filed: Sep. 10, 2004

(65) Prior Publication Data

US 2005/0052361 A1 Mar. 10, 2005

(30) Foreign Application Priority Data

Sep. 11, 2003 (JP) ..... 2003-320461

(51) Int. Cl.[7] ..... G09G 3/28

(52) U.S. Cl. ..... 345/60; 345/66; 345/68

(58) Field of Search ..... 345/41, 60, 62, 345/65, 66, 67, 68, 71, 76; 315/160–176; 313/450–456

(56) References Cited

U.S. PATENT DOCUMENTS

| | | | | |
|---|---|---|---|---|
| 6,882,116 | B2 * | 4/2005 | Araki | 315/169.4 |
| 6,882,328 | B2 * | 4/2005 | Araki | 345/60 |
| 2004/0108975 | A1 * | 6/2004 | Araki | 345/63 |
| 2005/0093776 | A1 * | 5/2005 | Furutani et al. | 345/60 |

FOREIGN PATENT DOCUMENTS

| | | |
|---|---|---|
| JP | 6-337654 A | 12/1994 |
| JP | 2001-117532 A | 4/2001 |

OTHER PUBLICATIONS

H. Hirakawa, "19.2 Cell Strusture and Driving Method of a 25–in (64–cm) Diagonal High–Resolution Color as Plasma Display", Society for Information Display, 98 Digest, (SID 98 Digest), pp. 279–281, May 1998.

* cited by examiner

*Primary Examiner*—Vijay Shankar
(74) *Attorney, Agent, or Firm*—Sughrue Mion, PLLC

(57) ABSTRACT

A method for driving an address-display separated-type AC (Alternating Current) PDP (Plasma Display Panel) is provided which is capable of having sequentially and continuously wall charges be formed sufficiently on a scanning electrode and sustaining electrode even when a width of a scanning pulse is shortened. Driving operations of a scanning driver and sustaining driver for the scanning electrode and the sustaining electrode during a pre-discharge period are the same as those employed in the conventional method. Driving operations for the scanning electrode during a scanning period are also the same as those in the conventional method except following. At ending time of a period during which a scanning pulse is applied to the scanning electrode, a potential difference obtained by superimposing a writing wall charge forming pulse on a sustaining pulse is applied for 3 μsec to 5 μsec. At an ending time of the application of the potential difference, wall charges having amounts larger than those achieved by the conventional method can be accumulated on the scanning electrode and the sustaining electrode.

26 Claims, 20 Drawing Sheets

METHOD FOR DRIVING ADDRESS-DISPLAY SEPARATED TYPE AC PLASMA DISPLAY PANEL AND DRIVING DEVICE USING SAME

BACKGROUND OF THE INVENTION

1. Field of the Invention

The present invention relates to a method for driving an address-display separated-type AC (alternating current) plasma display panel and a driving device using the method and more particularly to the method for driving the address-display separated-type AC plasma display panel (PDP) in which display with high definition is made possible and to the driving device using the above method.

The present application claims priority of Japanese Patent Application No. 2003-320461 filed on Sep. 11, 2003, which is hereby incorporated by reference.

2. Description of the Related Art

A plasma display panel (hereinafter may referred simply to as a "PDP") has, in general, many advantages in that it can be made thin, display on a large screen is made possible with comparative ease, it can provide a wide viewing angle, it can give a quick response, and a like. Therefore, in recent years, the PDP is being widely and increasingly used, as a flat display panel, for wall-hung televisions, public information boards, or a like.

The PDP is roughly classified, depending on its operating method, into two types, one being a DC (Direct Current)-type PDP and another being an AC-type PDP. The DC-type PDP is a PDP whose electrodes are exposed in a discharge space and which is operated in a direct-current discharge state. The AC-type PDP is a PDP whose electrodes are coated with a dielectric layer and are not exposed directly in a discharge gas and which is operated in an alternating-current discharge state. In the DC-type PDP, only while a voltage is being applied, discharge occurs. In the AC-type PDP, discharge is sustained by reversing a polarity of a voltage to be applied. The AC-type PDP is also classified into two types, one being a two-electrode type whose number of electrodes in a display cell is two and another being a three-electrode type whose number of electrodes in the display cell is three.

The three-electrode AC-type PDP will be described below. A plasma display panel 110 of the PDP, as shown in FIG. 18, is so constructed that it has a front substrate 120 and a rear substrate 121, both facing each other and ribs (partition walls) (not shown) are arranged at specified intervals in a matrix form, in a direction being vertical to a surface of a paper for the drawing, between the front substrate 120 and rear substrate 121. The above ribs arranged in the matrix form operate to play a role of providing discharge space 126*ij* (i=any one of 1, 2, . . . , and m, and j=any one of 1, 2, . . . , and n) and of partitioning display cells 131*ij* ($\mathbf{131}_{24}$ in FIG. 19). The "m" is equal to the number of horizontal scanning lines making up video signals in one frame and the "n" is equal to the number of pixels making up each of the horizontal scanning lines.

On each region on the front substrate 120 being placed by the rib apart from the rear substrate 121 at a specified interval and being partitioned by the rib are arranged one scanning electrode 122*i* and one sustaining electrode 123*i* (see FIG. 18) and on each region on the rear substrate 121 being placed apart from the front substrate 120 and being partitioned by the rib is arranged a data electrode 129*j* in a manner to be orthogonal to the scanning electrode 122*i* and sustaining electrode 123*i*. At each of intersecting points, arranged in a matrix form, where each of the scanning electrodes 122*i*, each of the sustaining electrodes 123*i*, and each of the data electrodes 129*j* intersect one another is formed one display cell 131*ij* ($\mathbf{131}_{24}$ in FIG. 19) making up the PDP.

A metal layer 132*i* is stacked on each of the scanning electrodes 122*i* and each of the sustaining electrodes 123*i* which are formed on the front substrate 120 made up of a glass substrate or a like (see FIG. 18) and a transparent dielectric layer 124 is stacked all over the metal layer 132*i*, each of scanning electrode 122*i*, each of the sustaining electrode 123*i* and then a protecting layer 125 is stacked on the transparent dielectric layer 124. The metal layer 132*i* is a layer formed to lower wiring resistance and the protecting layer 125 is a layer made of MgO (magnesium oxide) or a like and to protect the transparent dielectric layer 124 from discharge. On the other hand, a white dielectric layer 128 and a phosphor layer 127 are sequentially stacked all over the data electrodes 129*j* formed on the rear substrate 121 made up of a glass substrate or a like.

A discharge space 126*ij* in the three-electrode AC-type PDP 110 having such the configurations as above is filled with a mixed gas of He (helium), Ne (neon), Xe (xenon), and a like in a hermetically sealed manner. As a reference material describing such the conventional three-electrode AC-type PDP, "Society for Information Display 98 Digest" (SID 98 DIGEST) (Page 279 to 281, May, 1998) is available.

Next, configurations of a driving circuit for the conventional three-electrode AC-type PDP 110 are described by referring to FIG. 20. The driving circuit, as shown in FIG. 20, is made up of a scanning driver 134*i*, a sustaining driver 136, and a data driver 138*j* (not shown in FIG. 20). The scanning driver 134*i* applies a voltage described later to scanning electrodes Si (122*i* in FIG. 18 and S1, S2, . . . , Sm in FIG. 19) in a pre-discharge period 2, scanning period 3, and sustaining period 4 (shown in FIG. 21). The sustaining driver 136 applies a voltage described later to sustaining electrodes Ci (123*i* in FIG. 18 and C1, C2, . . . , Cm in FIG. 19) in the pre-discharge period 2, scanning period 3, and sustaining period 4. The data driver 138*j* (not shown) applies a data pulse to data electrodes Dj (129*j* in FIG. 18 and see FIG. 19) in the scanning period 3. Relations among the pre-discharge period 2, scanning period 3, and sustaining period 4 are as follows. That is, one field during which video signals are applied includes two or more sub-fields, each of which is made up of the pre-discharge period 2, scanning period 3, and sustaining period 4. During each of sub-fields, signals to be applied in one field are applied.

The scanning driver 134*i*, as shown in FIG. 20, is made up of a pre-discharge power feeding circuit 142 to feed a voltage, in the pre-discharge period 2, to be used for operations of resetting wall charges accumulated on a dielectric layer in the scanning electrode Si and operations of priming discharge, a scanning power feeding circuit 144 to feed a voltage ("Vbw") to be used to produce a scanning pulse to be applied in synchronization with a data pulse in the scanning period 3, a first power feeding circuit 146 to feed a voltage to be used to produce a sustaining pulse in the sustaining period 4, a pMOS (P-channel Metal Oxide Semiconductor Filed Effect Transistor) Ti1 whose source is connected to a line 147, an nMOS (N-channel MOS FET) Ti2 whose drain is connected to a drain of the nMOS Ti2 and a scanning control circuit 148 (shown in FIG. 20)). A source of the nMOS Ti2 is connected to a terminal of a ground potential GND. A connecting point between the pMOS Ti1 and nMOS Ti2 is connected to the scanning electrode Si. The sustaining driver 136 is made up of a second power feeding circuit 150 to feed a sustaining voltage Vs (C1, C2, . . . , Cm in FIG. 21), a switch Ts, a switch Tg, and a sustaining control circuit 152.

The pre-discharge power feeding circuit 142 is used to reset wall charges accumulated in the sustaining period 4 in a previous sub-field by using a sawtooth-like wave signal to be first applied in the pre-discharge period 2 (see FIG. 21) and to make priming discharge occur by using a sawtooth-like wave signal to be secondly applied in the pre-discharge period 2 and to output a voltage having such voltage waveforms as shown as S1, S2, . . . , Sm in FIG. 21 to be used for adjusting wall charges occurred by the priming discharge by using a sawtooth-like wave signal to be lastly applied in the pre-discharge period 2. The scanning power feeding circuit 144 is made up of a voltage source 145 and a switch Tbw whose one terminal is connected to the voltage source 145 and outputs the voltage "Vbw" from the voltage source 145 in the scanning period 3 to the line 147. The first power feeding circuit 146 outputs a voltage Vs to the line 147 in the sustaining period 4.

The scanning control circuit 148 operates to receive video signals and to feed each of control pulses described below to the pMOS Ti1 and nMOS Ti2. That is, the scanning control circuit 148 feeds a control pulse to turn ON the pMOS Ti1 to a gate of the pMOS Ti1 and a control pulse to turn OFF the nMOS Ti2 to a gate of the nMOS Ti2 in the pre-discharge period 2 during which the three kinds of sawtooth-like wave signals described above are fed from the pre-discharge power feeding circuit 142.

The scanning control circuit 148 feeds, in a period during which a scanning pulse is applied, a control pulse to turn OFF the pMOS Ti1 to a gate of the pMOS Ti1 and a control pulse to turn ON the nMOS Ti2 to a gate of the nMOS Ti2, while it feeds, in the scanning period 3 other than the period during which a scanning pulse is applied, a control pulse to turn ON the pMOS Ti1 to the gate of the pMOS Ti1 and a control pulse to turn OFF the nMOS Ti2 to the gate of the nMOS Ti2.

The scanning control circuit 148 repeats operations, alternately for every half of a period during which a sustaining pulse is applied in the sustaining period 4, that the pMOS Ti1 is turned ON and the nMOS Ti2 is turned OFF in a first half of a period during which a sustaining pulse is being fed and a control pulse to turn OFF the nMOS Ti2 is fed to the gate of the pMOS Ti1 and a control pulse to turn ON the nMOS Ti2 is fed to the gate of the nMOS Ti2 in a second half of the period during which the sustaining pulse is being fed. These operations drive a sustaining driver 149 on a side in which scanning operations are performed.

The sustaining control circuit 152 making up the sustaining driver 136 operates to receive video signals and to feed each of control pulses described below to the pMOS Ti1 and nMOS Ti2. That is, it feeds a control pulse to turn ON a switch Ts to an ON/OFF control inputting port of the switch Ts and a control pulse to turn OFF a switch Tg to an ON/OFF control inputting port of the switch Tg in a period during which a first sawtooth-like wave signal out of the above three kinds of the sawtooth-like signals fed in the pre-discharge period 2 is fed. Then, it also feeds a control pulse to turn OFF the switch Ts to the ON/OFF control inputting port of the switch Ts and a control pulse to turn ON the switch Tg to the ON/OFF control inputting port of the switch Tg in a period during which a second sawtooth-like wave signal is fed. Further, it also feeds a control pulse to turn ON the switch Ts to the ON/OFF control inputting port of the switch Ts and a control pulse to turn OFF the switch Tg to the ON/OFF control inputting port of the switch Tg both in a period during which a last sawtooth-like wave signal is fed and in the scanning period 3.

Also, the sustaining control circuit 152 repeats operations, in the sustaining period 4, alternately during every half period during which a sustaining pulse is being applied, by which a control pulse to turn OFF the switch Ts is fed to the ON/OFF control inputting port of the switch Ts and a control pulse to turn ON the switch Tg is fed to the ON/OFF control inputting port of the switch Tg in a first half of the period during which the sustaining pulse is being fed and a control pulse to turn ON the switch Ts is fed to the ON/OFF control inputting port of the switch Ts and a control pulse to turn OFF the switch Tg is fed to the ON/OFF control inputting port of the switch Tg in a second half of the period during which the sustaining pulse is being fed. One terminal of the switch Ts is connected to the second power feeding circuit 150 and another terminal of the switch Ts is connected to one terminal of the switch Tg. A connecting point between the switch Ts and switch Tg is connected to the sustaining electrode Ci. Another terminal of the switch Tg is connected to a port for a ground potential.

Next, a method for driving the three-electrode address-display separated-type AC PDP 110 having configurations as described above is explained. Now, let it be assumed for explanation that operations during a sub-field 5 start (see FIG. 21). Amounts of wall charges to be formed, by discharge, on a dielectric layer of each electrode in a display cell differ depending on whether or not sustaining discharge has occurred in a sustaining period in a sub-field existing immediately before the sub-field 5. If next writing is done irrespective of such the difference in the amounts of wall charges, occurrence of writing discharge caused by the amounts of wall charges becomes difficult and erroneous writing occurs.

To solve this problem, conventionally, the scanning driver **134*i* operates to perform initializing (resetting) operations and priming discharge operations in the pre-discharge period 2 in the sub-field 5. That is, the scanning driver 134*i* turns ON the pMOS Ti1 and turns OFF the nMOS Ti2 to apply a first sawtooth-like wave signal to the scanning electrode Si and the sustaining driver 136 turns ON the switch Ts and OFF the switch Tg from a second half of a period during which a last sustaining pulse fed in the sustaining period 4 in the previous sub-field is being fed. In the period during which the above first sawtooth-like wave signal is being fed to the scanning electrode Si, a voltage Vs is applied to the sustaining electrode Ci and wall charges formed in the sustaining period 1** in the previous sub-field are reset.

Then, the scanning driver **134*i* turns ON the pMOS Ti1 and OFF the nMOS Ti2 to apply a second sawtooth-like wave signal to the scanning electrode Si, while the sustaining driver 136 turns OFF the switch Ts and ON the switch Tg to apply a ground potential to the sustaining electrode Ci, causing priming discharge to occur. Further, the scanning driver 134*i* turns ON the pMOS Ti1 and OFF the nMOS Ti2 to apply a last sawtooth-like wave signal to the scanning electrode Si and the sustaining driver 136 turns ON the switch Ts and OFF the switch Tg to apply the voltage Vs to the sustaining electrode Ci in a period during which the above last sawtooth-like wave signal is being applied and in the scanning period 3**, thus causing wall charges occurred by priming discharge to be adjusted. The priming discharge operations and wall charge adjusting operations are performed to achieve easy writing of display data to be done in a one-pass scanning manner according to display data, that is, to realize easy occurrence of discharge in a display cell.

When the pre-discharge period 2 described above ends, operations in the scanning period 3 start. From starting time of the scanning period 3, a voltage "Vbw" begins to be output from the voltage source 145 in the scanning driver 134*i* to the line 147 and to be applied to the scanning electrode Si and, as described above, from starting time of the application of the last sawtooth-like wave signal in the pre-discharge period 2, the voltage "Vs" begins to be applied to the sustaining electrode Ci from the sustaining driver 136. Time of termination of the application of the voltage "Vbw" to be output by the scanning driver 134*i* to the line 147 is the same as ending time of the scanning period 3 and time of termination of the application of the voltage Vs to be applied by the sustaining driver 136 to the sustaining electrode Ci is the same as ending time of the scanning period 3.

On the other hand, to the gate of the pMOS Ti1 is applied a pulse to turn OFF the pMOS Ti1 from the scanning control circuit 148 with same timing with which display data (pixel data) existing on the i-th scanning line is applied, which makes up video signals fed in one field, for example, display data to be fed to the data electrode Dj is fed and, at the same time, to the gate of the nMOS Ti2 is applied a pulse to turn on the nMOS Ti2 by the scanning control circuit 148 with same timing as described above.

Therefore, while a scanning pulse (see reference number 6 in FIG. 21) is being sequentially applied to the scanning electrodes S1 to Sm (see reference numbers S1 to Sm) in the sub-field 5, n-pieces of data pulse (see reference number 7) in each sub-field is applied to each of the data electrodes (see reference numbers D1 to Dn in FIG. 21) corresponding to each data pulse in the scanning period 3 during which the scanning pulse is being applied to each scanning electrode Si.

In a display cell (in the intersecting portion between the scanning electrode and data electrode) to which data pulse is fed, since a voltage between the scanning electrode Si and the data electrode Dj is boosted and, after the application of the voltage, writing discharge occurs between the scanning electrode Si and data electrode Dj with some time delay (hereinafter called a discharge delay), positive wall charges are formed on a side of the scanning electrode Si. Also, between the sustaining electrode Ci and scanning electrode Si (between surface electrodes) where a large bias is being applied in a potential state at the discharge time, since movements of electric charges occur by an electric field generated between the electrodes, negative wall charges are formed on the sustaining electrode Ci.

Contrary to the above case, in a display cell (pixel) to which a data pulse 7 is not fed, since a voltage between the scanning electrode Si and data electrode Dj is not boosted, writing discharge does not occur and a wall charge change that may occur in such the case where the data pulse 7 is applied does not occur.

Thus, depending on whether or not the data pulse 7 is applied to a display cell, two types of states of wall charges can be made to occur between the scanning electrode Si and sustaining electrode Ci. When these two states of wall charges are made to continue to exist during the subsequent sustaining period 4, display or no-display of the pixel continues. This operation is explained below.

When the application of a scanning pulse 6 to all the scanning electrodes Si (from i=1 to i=m) is terminated, operations in the sustaining period 4 start. A sustaining pulse is applied, by the sustaining driver 149 and sustaining driver 136 on a side where scanning operations are performed, alternately to all the scanning electrodes Si to Sm and all the sustaining electrodes Ci to Cm in a specified period. To the scanning electrode Si is first applied a positive sustaining pulse and then a negative sustaining pulse. The positive sustaining pulse and negative sustaining pulse are alternately applied. To the sustaining electrode Ci is applied a negative sustaining pulse first and then a positive sustaining pulse. The negative sustaining pulse and positive sustaining pulse are alternately applied. A voltage of each of these sustaining pulses is set at a voltage at which discharge (called surface discharge) between a scanning electrode Sk and a sustaining electrode Cl does not start in a display cell $\mathbf{131}_{K1}$ ("k" is one of 1, 2, . . . , m and "l" is one of 1, 2, . . . , n). More specifically the set voltage is 170 V.

Contrary to the above case, in a display cell $\mathbf{131}_{OP}$ ("O" is one of 1, 2, . . . , m and other than "k" and "P" is one of 1, 2, . . . , n other than "l") in which writing discharge has occurred, as described above, since a positive wall charge is formed on the scanning electrode $S_O$ and a negative wall charge is formed on the sustaining electrode $C_P$, a voltage to be produced by the positive and negative wall charges is superimposed on a voltage of the first positive sustaining pulse (called a "first sustaining pulse") to be applied to the scanning electrode $S_O$ in a forward direction. This causes a voltage exceeding a surface firing voltage to be applied to discharge space $\mathbf{126}_{OP}$ in the display cell $\mathbf{131}_{OP}$ and sustaining discharge occurs between the scanning electrode $S_O$ and the sustaining electrode $C_P$. By this sustaining discharge, negative wall charges are accumulated on the scanning electrode $S_O$ and positive wall charges on the sustaining electrode $C_P$, which reverses the accumulated state of wall charges.

When the application of the first sustaining pulse is completed, a voltage pulse to be applied to the scanning electrode $S_O$ from the sustaining driver 149 on the side where scanning operations are performed and a voltage pulse to be applied to the sustaining electrode $C_P$ from the sustaining driver 136 are reversed in phase and each of the phase-reversed voltage pulses (called a "second sustaining pulse") is applied to the corresponding scanning electrode $S_O$ and sustaining electrode $C_P$. A voltage of negative wall charges accumulated on the scanning electrode $S_O$ and a voltage of positive wall charges accumulated on the sustaining electrode $C_P$ are superimposed on a voltage of the second sustaining pulse to be applied as above in a forward direction and, as in the case of the first sustaining pulse, wall charges having a polarity being reverse to that of a voltage of the first sustaining pulse, that is, positive wall charges are accumulated on the scanning electrode $S_O$ and negative wall charges on the sustaining electrode $C_P$.

Even after the application of the second sustaining pulse has been terminated, since the application of the first sustaining pulse and the second sustaining pulse is repeated, discharge continues to occur between the scanning electrode $S_O$ and the sustaining electrode $C_P$. That is, a potential difference produced by wall charges formed on the scanning electrode $S_O$ and the sustaining electrode $C_P$ by the X-th sustaining discharge is superimposed on a voltage of the "X+1st" sustaining pulse, which causes the sustaining discharge to be sustained.

By operating as above, light-emitting in the display cell $\mathbf{131}_{OP}$ continues. Light-emitting luminance in the display cell $\mathbf{131}_{OP}$ is determined by the number of times of sustaining the sustaining discharge. Moreover, by changing the number of sustaining pulses to be applied in each sub-field, gray levels in the display cell $\mathbf{131}_{OP}$ can be adjusted.

A method is disclosed in Japanese Patent Application Laid-open No. Hei 6-337654 in which, in an address-while-display (AWD) driving method in which scanning operations are performed while a sustaining pulse is being applied, after application of a scanning pulse, a pulse having a polarity being reverse to a scanning pulse is applied to an electrode to which a scanning pulse is not applied, out of two surface electrodes. Also, a method is disclosed in Japanese Patent Application Laid-open No. 2001-117532 in which pulse application time is provided between time for application of a scanning pulse and time for application of a subsequent pulse and, during the pulse application time, a pulse having a polarity being reverse to that of the scanning pulse is applied to a sustaining electrode.

In the conventional method for driving the address-display separated-type AC PDP performing such operations as above, when an image with high definition is to be displayed by increasing the number of scanning lines, the scanning period 3 is lengthened as the number of the scanning lines increases. If a frequency to be used in one field is fixed to be 60 Hz, a length of the sustaining period 4 corresponding to an increased length of the scanning period 3 is decreased. The decrease in the length of the sustaining period 4 causes lowering of light-emitting luminance which degrades a display characteristic.

An available countermeasure to avoid the above degradation includes a method by which the number of sub-fields is decreased and another method by which a width of a scanning pulse is decreased. However, the decrease in the number of sub-fields causes a decrease in the number of gray levels or occurrence of false contouring of moving images.

The decrease in a width of a scanning pulse presents the following problems. That is, as is apparent from above descriptions, in the conventional driving method, when application of a scanning pulse is terminated, a potential of the scanning electrode Si is boosted to become a voltage "Vbw", a potential difference between the scanning electrode Si and sustaining electrode Ci is reduced to be a voltage of "Vs−Vbw". This means that amounts of movements of space charges which are formed between the scanning electrode Si and sustaining electrode Ci at time of the application of the scanning pulse 6 and which produce wall charges on each of electrodes rapidly becomes small at the same time when the application of the scanning pulse 6 is terminated, which causes further formation of wall charges to be weakened.

That is, since time before the application of the scanning pulse is terminated after writing discharge has started is shortened, formation of wall charges sufficiently enough to let operations in the scanning period 3 shift to have sustaining discharge occur in the sustaining period 4 on the scanning electrode Si and sustaining electrode Ci becomes difficult.

In such the state in which sufficient wall charges are not formed on the scanning electrode Si and sustaining electrode Ci, even if the first sustaining pulse is applied when operations in the sustaining period 4 start and shift to sustaining discharge and even if a voltage of a wall charge formed by the writing discharge is superimposed on the voltage "Vs" of the first sustaining pulse, since the wall charges are not formed sufficiently as described above, a potential difference between the scanning electrode Si and sustaining electrode Ci does not reach a potential difference required for making sustaining discharge occur, that is, does not reach a surface firing voltage being a minimum voltage required for occurrence of surface discharge.

Therefore, unless sufficiently intense discharge occurs before operations start in the sustaining period and unless, when the first sustaining pulse is applied after the occurrence of the intense discharge, a wall charge having a polarity being reverse to that of the wall charge formed by the above discharge is formed on the scanning electrode Si and sustaining electrode Ci, operations do not shift to have sustaining discharge occur with reliability, thus causing a display cell not to be lit or a flicker to occur in displayed images.

To improve points described above, a voltage of a sustaining pulse or of a data pulse has to be boosted. This causes an increase in power consumption and/or use of an expensive driver that can withstand a high voltage, which leads to high costs.

In the address-while-display (AWD) driving method disclosed in Japanese Patent Application Laid-open No. Hei 6-337654 in which scanning operations are performed while a sustaining pulse is being applied, after the application of a scanning pulse, a pulse having a polarity being reverse to that of the scanning pulse is applied to an electrode, out of two surface electrodes, to which the scanning pulse has not been applied. However, simple application of this method to the address-display separated method does not produce a satisfactory effect. To obtain sufficient effects, optimization of a pulse voltage, a position of a pulse to be applied, and a width of the pulse is necessary.

In the method disclosed in Japanese Patent Application Laid-open No. 2001-117532, pulse application time is provided between time for application of a scanning pulse and time for application of a subsequent pulse and, during the pulse application time, a pulse having a polarity being reverse to that of the scanning pulse is applied to a sustaining electrode. Therefore, the pulse application time during which a pulse is applied to a sustaining electrode between time for application of a scanning pulse and time for application of a subsequent pulse is additionally required. As a result, this method enables the scanning pulse to be shortened, however, a scanning period cannot be shortened.

SUMMARY OF THE INVENTION

In view of the above, it is an object of the present invention to provide a method for driving an address-display separated-type AC PDP which is capable of, only if writing discharge occurs once, having sequentially and continuously wall charges be formed sufficiently on a scanning electrode and a sustaining electrode and of maintaining a sustaining discharge even when a width of a scanning pulse is shortened and even if the PDP is driven at a low sustaining voltage, and a plasma display device driven by using the driving method.

According to a first aspect of the present invention, there is provided a method for driving an address-display separated-type AC (Alternating Current) plasma display panel in which a first insulating substrate and a second insulating substrate are mounted at a specified interval in a manner to oppose to each other, a first specified number of pairs of a scanning electrode and a sustaining electrode being positioned in parallel to each other is arranged on a face of the first insulating substrate, the face being opposite to the second insulating substrate, and a second specified number of data electrodes being positioned in orthogonal to each of the pairs of the scanning electrode and the sustaining electrode is arranged on a face of the second insulating substrate, the face being opposite to the first insulating substrate, wherein pixel data corresponding to a video signal is sequentially written in a scanning period in each of display cells formed at an intersecting point between each of the pairs of the scanning electrode and sustaining electrode and each of the data electrodes and displaying of written pixels is sustained by sustaining discharge in a sustaining period, the method including:

a step of applying a scanning pulse to each of the scanning electrodes in the scanning period with different timing; and a step of feeding across the scanning electrode and the sustaining electrode making up the pair, for a first specified period of time from first specified time after termination of a period during which the scanning pulse is applied, a potential difference being two-thirds or more of a surface firing voltage at which surface discharge occurs between the scanning electrode and the sustaining electrode making up the pair and being the potential difference at which no discharge is started between the scanning electrode and the sustaining electrode making up the pair, between the scanning electrode and the sustaining electrode making up the pair.

In the foregoing, a preferable mode is one wherein the first specified time is arbitrary time existing between time of termination of a period during which the scanning pulse is applied and time at which formation of wall charges required for the sustaining discharge is unable to occur and the first period of time is a period of time that can be arbitrarily selected during a period of time existing from the first specified time to time at which, though formation of wall charges is made to continue by movements of space charges between the scanning electrode and the sustaining electrode making up the pair, no erroneous discharge occurs.

Also, a preferable mode is one wherein, by applying a writing wall charge forming pulse, having a polarity reverse to that of the scanning pulse, to the sustaining electrode being paired with the scanning electrode to which the scanning pulse is applied during the period of time from the arbitrary time, the potential difference is generated between the scanning electrode and the sustaining electrode making up the pair.

Also, a preferable mode is one, wherein, by dividing the two or more sustaining electrodes into two sustaining electrode groups and by sequentially and alternately applying the scanning pulse to the scanning electrode selected from scanning electrodes being paired with the sustaining electrode making up each of the two sustaining electrode groups and by alternately applying a writing wall charge forming pulse, having a polarity reverse to that of the scanning pulse, to each of the sustaining electrodes in the group to which the sustaining electrode being paired with the scanning electrode to which the scanning pulse is applied belongs from time of termination of a period during which the scanning pulse is applied to a period of the first specified period of time in a period of application of the scanning pulse in every group, the potential difference is made to be generated between the scanning electrode and the sustaining electrode making up the pair.

According to a second aspect of the present invention, there is provided a method for driving an address-display separated-type AC (Alternating Current) plasma display panel in which a first insulating substrate and a second insulating substrate are mounted at a specified interval in a manner to oppose to each other, a first specified number of pairs of a scanning electrode and a sustaining electrode being positioned in parallel to each other is arranged on a face of the first insulating substrate, the face being opposite to the second insulating substrate, and a second specified number of data electrodes being positioned in orthogonal to each of the pairs of the scanning electrode and the sustaining electrode is arranged on a face of the second insulating substrate, the face being opposite to the first insulating substrate, wherein pixel data corresponding to a video signal is sequentially written in a scanning period in each of display cells formed at an intersecting point between each of the pairs of the scanning electrode and sustaining electrode and each of the data electrodes and displaying of written pixels is sustained by sustaining discharge,in a sustaining period, the method including:

a step of applying a scanning pulse to each of the scanning electrodes in the scanning period with different timing; and a step of feeding across the scanning electrode and the sustaining electrode making up the pair, for a second specified period of time from second specified time before termination of a period during which the scanning pulse is applied, a potential difference being two-thirds or more of a surface firing voltage at which surface discharge occurs between the scanning electrode and the sustaining electrode making up the pair and being the potential difference at which no discharge occurs between the scanning electrode and the sustaining electrode making up the pair between the scanning electrode and the sustaining electrode making up the pair.

In the foregoing, a preferable mode is one wherein the second specified time is arbitrary time existing between time after time of termination of a period during which no erroneous discharge occurs when the potential difference is applied between the scanning electrode and the sustaining electrode making up the pair and time of termination of a period during which the scanning pulse is applied and wherein the second period of time is a period of time that can be arbitrarily selected during a period of time existing from the second specified time to time at which, though formation of wall charges is made to continue by movements of space charges between the scanning electrode and the sustaining electrode making up the pair, no erroneous discharge occurs.

Also, a preferable mode is one wherein, by applying a writing wall charge forming pulse, having a polarity reverse to that of the scanning pulse, to the sustaining electrode being paired with the scanning electrode to which the scanning pulse is applied during the period of time from the arbitrary time, the potential difference is generated between the scanning electrode and sustaining electrode making up the pair.

According to a third aspect of the present invention, there is provided a method for driving an address-display separated-type AC (Alternating Current) plasma display panel in which a first insulating substrate and a second insulating substrate are mounted at a specified interval in a manner to oppose to each other, a first specified number of pairs of a scanning electrode and a sustaining electrode being positioned in parallel to each other is arranged on a face of the first insulating substrate, the face being opposite to the second insulating substrate, and a second specified number of data electrodes being positioned in orthogonal to each of the pairs of the scanning electrode and the sustaining electrode is arranged on a face of the second insulating substrate, the face being opposite to the first insulating substrate, wherein pixel data corresponding to a video signal is sequentially written in a scanning period in each of display cells formed at an intersecting point between each of the pairs of the scanning electrode and sustaining electrode and each of the data electrodes and displaying of written pixels is sustained by sustaining discharge in a sustaining period, the method including:

a step of applying a scanning pulse to each of the scanning electrodes during the scanning period with different timing; and a step of feeding across the scanning electrode and the sustaining electrode making up the pair, in the scanning period during which the scanning pulse is not applied, a potential difference being two-thirds or more of a surface firing voltage at which surface discharge occurs between the scanning electrode and the sustaining electrode making up the pair and being the potential difference at which no discharge occurs between the scanning electrode and the sustaining electrode making up the pair.

In the foregoing, a preferable mode is one wherein, by applying a sustaining base voltage, having a polarity reverse to that of the scanning pulse, in the scanning period during which the scanning pulse is not applied to the sustaining electrode being paired with the scanning electrode to which the scanning pulse is applied, the potential difference is produced between the scanning electrode and the sustaining electrode making up the pair.

Also, a preferable mode is one wherein a potential of the scanning pulse is lower by a specified value than a potential of the scanning pulse being applied in the scanning period other than a period during which the scanning pulse is applied.

According to a fourth aspect of the present invention, there is provided a driving device for an address-display separated-type AC plasma display panel including:

a plasma display panel in which a first insulating substrate and a second insulating substrate are mounted at a specified interval in a manner to oppose to each other, a first specified number of pairs of a scanning electrode and a sustaining electrode being positioned in parallel to each other is arranged on a face of the first insulating substrate, the face being opposite to the second insulating substrate, and a second specified number of data electrodes being positioned in orthogonal to each of the pairs of the scanning electrode and the sustaining electrode is arranged on a face of the second insulating substrate, the face being opposite to the first insulating substrate, display cells each are formed at an intersecting point between each of the pairs of the scanning electrode and sustaining electrode and each of the data electrodes;

a writing unit to sequentially write pixel data corresponding to a video signal to each display cell in the plasma display panel in a scanning period;

a display sustaining unit to sustain displaying of a pixel written by the writing unit by sustaining discharge for a sustaining period; and a potential difference applying unit to apply across the scanning electrode and the sustaining electrode making up the pair, for a first specified period of time from first specified time after termination of a period during which the scanning pulse is applied to each scanning electrode by the writing unit in the scanning period with different timing, a potential difference being two-thirds or more of a surface firing voltage at which surface discharge occurs between the scanning electrode and the sustaining electrode making up the pair and being the potential difference at which no discharge is made to be started between the scanning electrode and the sustaining electrode making up the pair, between the scanning electrode and the sustaining electrode making up the pair.

In the foregoing, a preferable mode is one wherein the first specified time during which the potential difference is applied by the potential difference applying unit is arbitrary time existing between time of termination of a period during which the scanning pulse is applied and time that no formation of wall charges required for the sustaining discharge occur and wherein the first specified period of time is time that can be arbitrarily selected during a period of time from the first specified time to time at which, though formation of wall charges is made to continue by movements of space charges between the scanning electrode and the sustaining electrode making up the pair, no erroneous discharge occurs.

Also, a preferable mode is one wherein the potential difference applying unit is a sustaining driver which applies a writing wall charge forming pulse, having a polarity reverse to that of the scanning pulse, to the sustaining electrode being paired with the scanning electrode to which the scanning pulse is applied during the period of time from the arbitrary time to generate the potential difference between the scanning electrode and the sustaining electrode making up the pair.

Also, a preferable mode is one wherein the potential difference applying unit is a sustaining driver which divides two or more sustaining electrodes into two sustaining electrode groups, applies sequentially and alternately the scanning pulse to the scanning electrode selected from scanning electrodes being paired with the sustaining electrode making up each of the two sustaining electrode groups and applies alternately a writing wall charge forming pulse, having a polarity reverse to that of the scanning pulse, to each of the sustaining electrodes in the group to which the sustaining electrode being paired with the scanning electrode to which the scanning pulse is applied belongs from time of termination of a period during which the scanning pulse is applied to a period of the first specified period of time in a period of application of the scanning pulse in every group, the potential difference is made to be generated between the scanning electrode and the sustaining electrode making up the pair.

According to a fifth aspect of the present invention, there is provided a driving device for an address-display separated-type AC plasma display panel including:

a plasma display panel in which a first insulating substrate and a second insulating substrate are mounted at a specified interval in a manner to oppose to each other, a first specified number of pairs of a scanning electrode and a sustaining electrode being positioned in parallel to each other is arranged on a face of the first insulating substrate, the face being opposite to the second insulating substrate, and a second specified number of data electrodes being positioned in orthogonal to each of the pairs of the scanning electrode and the sustaining electrode is arranged on a face of the second insulating substrate, the face being opposite to the first insulating substrate, display cells are formed at an intersecting point between each of the pairs of the scanning electrode and sustaining electrode and each of the data electrodes;

a writing unit to sequentially write pixel data corresponding to a video signal to each display cell in the plasma display panel during a scanning period; and a display sustaining unit to sustain displaying of a pixel written by the writing unit by sustaining discharge for a sustaining period; and a potential difference applying unit to apply across the scanning electrode and the sustaining electrode making up the pair, for a second specified period of time from second specified time before termination of a period during which the scanning pulse is applied to each scanning electrode by the writing unit in the scanning period with different timing, a potential difference being two-thirds or more of a surface firing voltage at which surface discharge occurs between the scanning electrode and the sustaining electrode making up the pair and being the potential difference at which no discharge is made to be started between the scanning electrode and the sustaining electrode making up the pair, between the scanning electrode and the sustaining electrode making up the pair.

In the foregoing, a preferable mode is one wherein the second specified time during which the potential difference applying unit applies the potential difference between the scanning electrode and the sustaining electrode making up the pair is arbitrary time existing between time after time of termination of a period during which no erroneous discharge occurs when the potential difference is applied between the scanning electrode and the sustaining electrode making up the pair and during which the scanning is applied and time of termination of a period during which the scanning pulse is applied and wherein the second period of time is a period of time that can be arbitrarily selected during a period of time from the second specified time to time at which, though formation of wall charges is made to continue by movements of space charges between the scanning electrode and the sustaining electrode making up the pair, no erroneous discharge occurs.

Also, a preferable mode is one wherein the potential difference applying unit is a sustaining driver which applies a writing wall charge forming pulse, having a polarity reverse to that of the scanning pulse, to the sustaining electrode being paired with the scanning electrode to which the scanning pulse is applied during the period of time from the arbitrary time to generate the potential difference between the scanning electrode and the sustaining electrode making up the pair.

According to a sixth aspect of the present invention, there is provided a driving device for an address-display separated-type AC plasma display panel including:

a plasma display panel in which a first insulating substrate and a second insulating substrate are mounted at a specified interval in a manner to oppose to each other, a first specified number of pairs of a scanning electrode and a sustaining electrode being positioned in parallel to each other is arranged on a face of the first insulating substrate, the face being opposite to the second insulating substrate, and a second specified number of data electrodes being positioned in orthogonal to each of the pairs of the scanning electrode and the sustaining electrode is arranged on a face of the second insulating substrate, the face being opposite to the first insulating substrate, display cells are formed at an intersecting point between each of the pairs of the scanning electrode and sustaining electrode and each of the data electrodes; a writing unit to sequentially write pixel data corresponding to a video signal to each display cell in the plasma display panel during a scanning period;

a display sustaining unit to sustain displaying of a pixel written by the writing unit by sustaining discharge for a sustaining period;

a potential difference applying unit to apply across the scanning electrode and the sustaining electrode making up the pair, for the scanning period during which the scanning pulse is not applied by the writing unit to the scanning electrode, a potential difference being two-thirds or more of a surface firing voltage between the scanning electrode and the sustaining electrode making up the pair and being the potential difference at which no erroneous discharge occurs between the scanning electrode and the sustaining electrode making up the pair, between the scanning electrode and the sustaining electrode making up the pair.

In the foregoing, a preferable mode is one wherein the potential difference applying unit is a sustaining driver which applies a sustaining base voltage, having a polarity reverse to that of the scanning pulse, to the sustaining electrode being paired with the scanning electrode in the scanning period during which the scanning pulse is not applied to generate the potential difference between the scanning electrode and the sustaining electrode making up the pair.

Also, a preferable mode is one wherein the sustaining driver, in the scanning period, after having applied the sustaining base voltage to the sustaining electrode, immediately before the scanning pulse is applied to the scanning electrode, for a period from the time immediately before the application of the scanning pulse to time of termination of the scanning pulse, puts all the sustaining electrodes into a floating state.

Also, a preferable mode is one wherein the sustaining driver, in the scanning period, after having applied the sustaining base voltage to the sustaining electrode, puts all the sustaining electrodes into a floating state and then all the sustaining electrodes are connected through a diode to a port having a specified voltage being lower than that of the sustaining electrode so that the sustaining electrode is operated as a cathode.

Furthermore, a preferable mode is one wherein a potential of the scanning pulse to be applied by the writing unit to the scanning electrode is lower by a specified value than a potential occurring in the scanning period other than the period during which the scanning pulse is applied.

With the above configuration, a potential which is equal to two-thirds or more of a surface firing voltage between a scanning electrode and a sustaining electrode and is equal to a voltage or less at which no discharge starts between the scanning electrode and sustaining electrode is applied between the scanning electrode and the sustaining electrode, after application of a scanning pulse, in a period during which, though formation of wall charges is facilitated by movements of a space charge, no erroneous discharge occurs and, therefore, it is possible to successfully solve technical problems occurring when a method of accommodating an increase in a scanning period associated with display of images with high definition by shortening a pulsing period of a scanning pulse, that is, the technical problems in that prevention of a voltage of a sustaining pulse and data pulse from becoming high cannot be easily achieved and accumulation of sufficient wall charges required for occurrence of sustaining discharge at time of terminating the application of the scanning pulse is difficult.

The prevention of a voltage of a sustaining pulse and data pulse from becoming high can be achieved by suppressing an increase in a minimum sustaining pulse voltage "Vdsmin" at which normal operations can be performed and/or in a minimum data pulse voltage "Vdmin" at which normal operations can be performed. Since such the above effects can be obtained, a shift of operations to have sustaining discharge occur with reliability is made possible, which serves to prevent a display cell from being not lit and/or to avoid occurrence of a flicker in displaying.

With another configuration, two or more sustaining electrodes are commonly driven and, therefore, a sustaining driver can be simplified and costs can be reduced.

Moreover, the present invention can be applied to a driving method for an address-display separated PDP other than three-electrode AC PDP.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Figure 1:
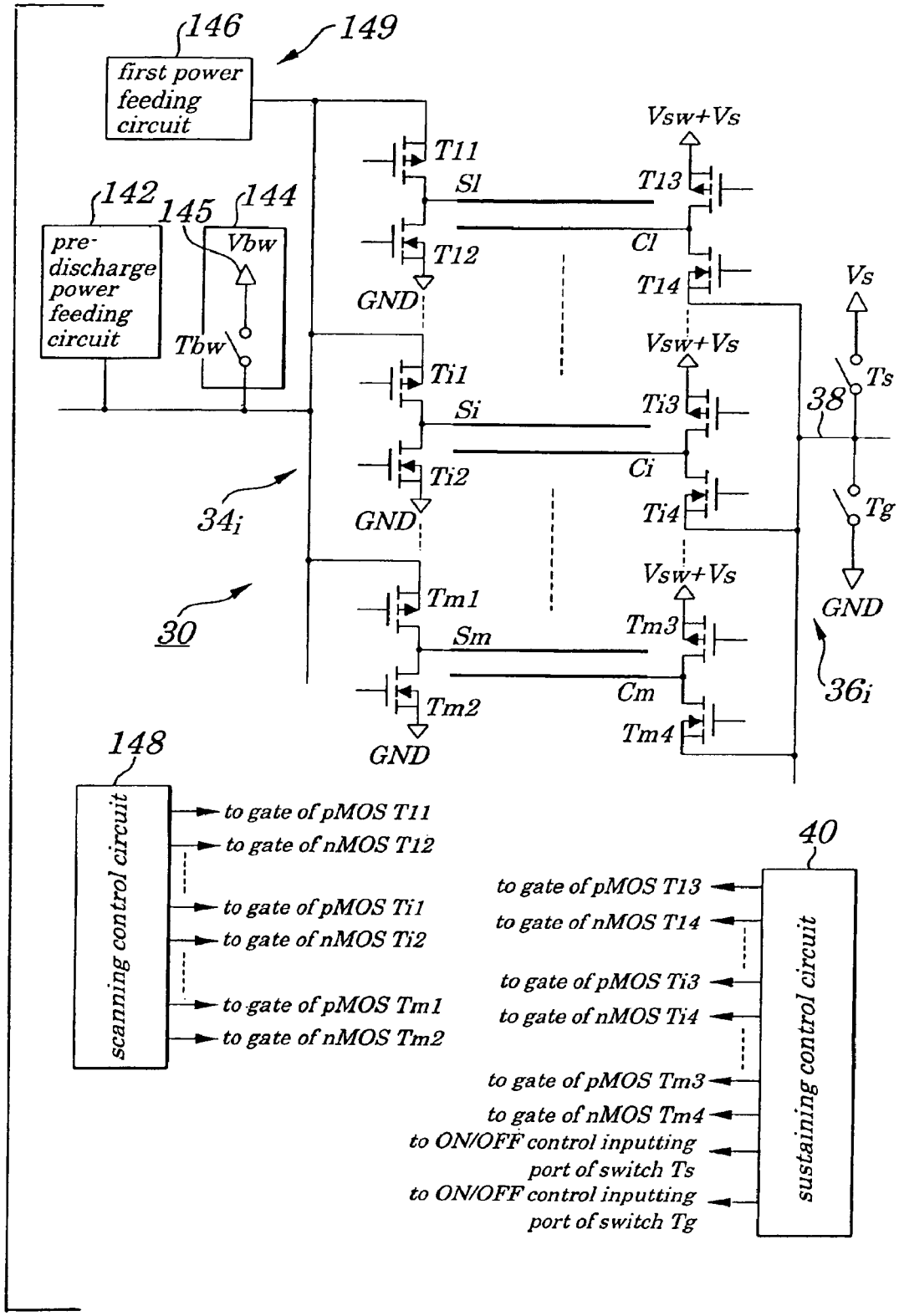
FIG. 1 is a diagram illustrating configurations of a driving device of an address-display separated-type AC PDP according to a first embodiment of the present invention.

Best modes of carrying out the present invention will be described in further detail using various embodiments with reference to the accompanying drawings. According to the present invention, when a PDP having a display cell formed at an intersecting point among each of two or more scanning electrodes and sustaining electrodes arranged in a manner to be parallel to one another and to make up pairs and each of two or more data electrodes each being arranged in a manner to be orthogonal to each of the scanning electrodes and sustaining electrodes is driven by an address-display separated method, a method of using a potential difference applying means is employed by which a voltage being equal to two-thirds or more of a surface firing voltage between each of the scanning electrodes and each of the sustaining electrodes and equal to the voltage or less at which no discharge occurs between each of the scanning electrodes and each of the sustaining electrodes is applied to a scanning electrode and a sustaining electrode, after termination of application of a scanning pulse to be sequentially applied, with different timing, to each of the scanning electrodes in a scanning period, from specified time within a first time during which, even if a potential difference occurred by writing on a display cell is applied between each of the scanning electrodes and each of the sustaining electrodes, movements of space charges caused by writing discharge on a display cell are reduced to a degree to which formation of wall charges sufficiently enough to maintain sustaining discharge in a sustaining period becomes impossible and in a first period during which, though formation of wall charges is facilitated by movements of space charges between each of the scanning electrodes and each of the sustaining electrodes, no erroneous discharge occurs.

Also, according to the present invention, when the PDP having a display cell formed at an intersecting point among each of two or more scanning electrodes and sustaining electrodes arranged in a manner to be parallel to one another and to make up pairs and each of two or more data electrodes each being arranged in a manner to be orthogonal to each of the scanning electrodes and sustaining electrodes is driven by an address-display separated method, a method of using a potential difference applying means is employed, by which, for a period from specified time within second time during which, even if the voltage being equal to two-thirds or more of a surface firing voltage between each of the scanning electrodes and each of the sustaining electrodes and being equal to a voltage or less at which no discharge occurs between each of the scanning electrodes and each of the sustaining electrodes is applied between each of the scanning electrodes and each of the sustaining electrodes, no erroneous discharge occurs, before termination of sequential application of a scanning pulse, with different timing, to each of the scanning electrodes in the scanning period, to a second period of time during which, though formation of wall charges is facilitated by movements of space charges between each of the scanning electrodes and each of the sustaining electrodes, no erroneous discharge occurs, the above potential difference is applied to each of the scanning electrodes and each of the sustaining electrodes.

Furthermore, according to the present invention, when the PDP having a display cell formed at an intersecting point among each of two or more scanning electrodes and sustaining electrodes arranged in a manner to be parallel to one another and to make up pairs and each of two or more data electrodes each being arranged in a manner to be orthogonal to each of the scanning electrodes and sustaining electrodes is driven by an address-display separated method, a method of using a potential difference applying means is employed, by which, in the scanning period during which a scanning pulse to be sequentially applied, with different timing, is not applied to each of the scanning electrodes, a potential difference is applied at which no erroneous discharge occurs between each of the scanning electrodes and each of the sustaining electrodes even if a voltage being equal to two-thirds or more of a surface firing voltage between each of the scanning electrodes and each of the sustaining electrodes and being equal to the voltage or less at which no discharge occurs between each of the scanning electrodes and each of the sustaining electrodes is applied between each of the scanning electrodes and each of the sustaining electrodes.

FIRST EMBODIMENT

Figure 2:
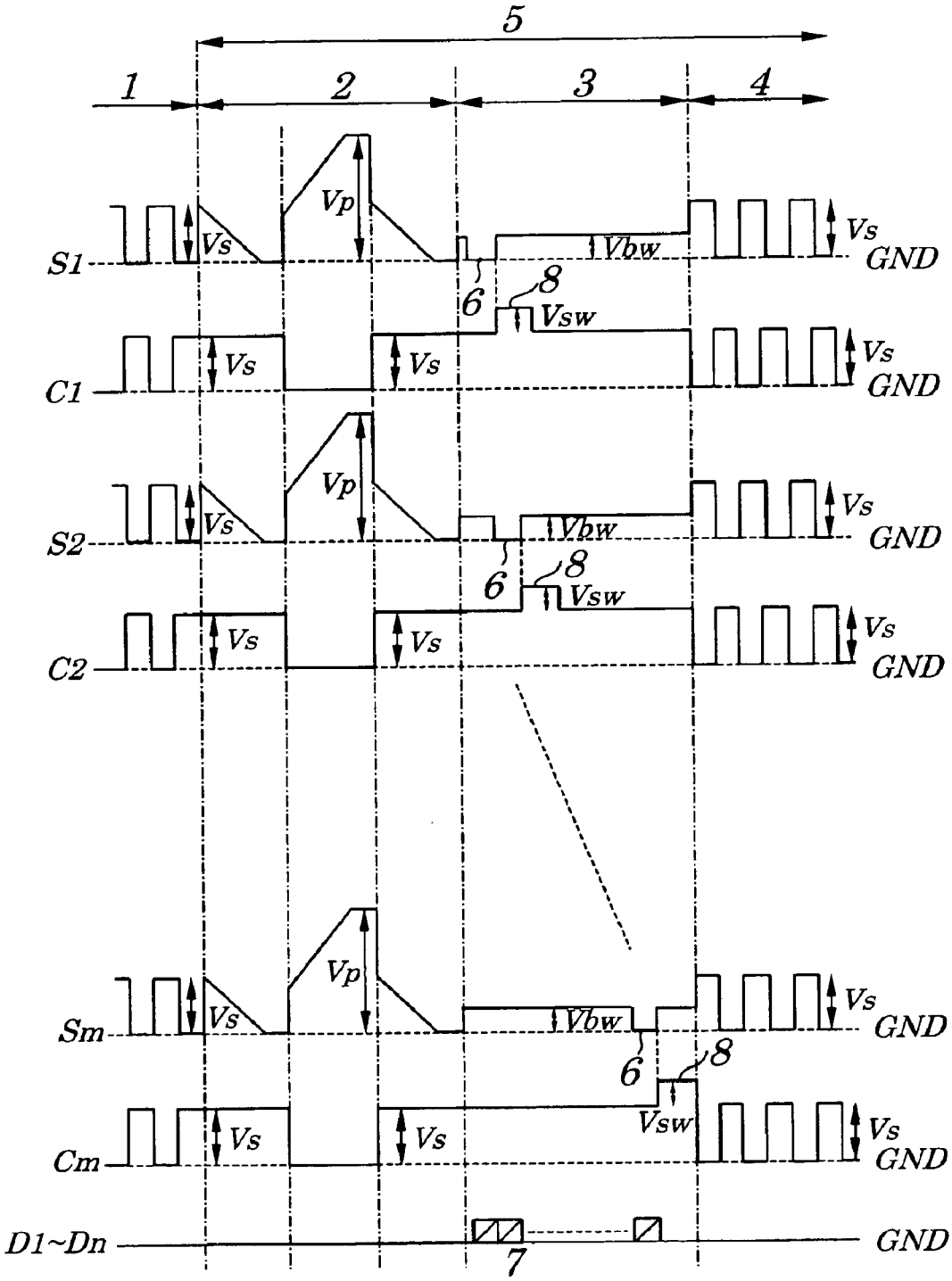
FIG. 2 is a diagram showing driving waveforms of pulses to drive the address-display separated-type AC PDP according to the first embodiment of the present invention.
Figure 3A:
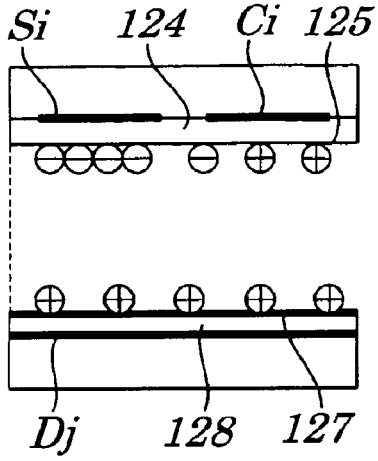
FIGS. 3A to 3E are diagrams illustrating changes of states of wall charges formed when the address-display separated-type AC PDP is driven according to the first embodiment of the present invention.
Figure 3B:
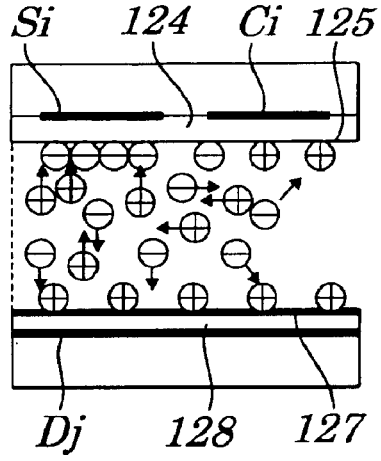
Figure 3C:
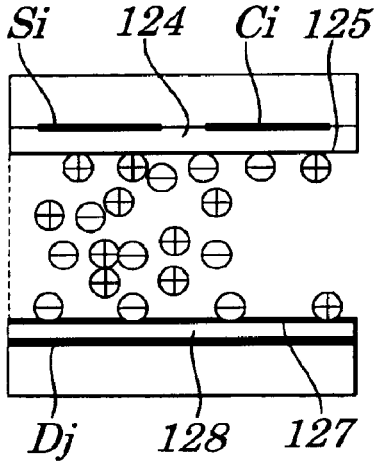
Figure 4:
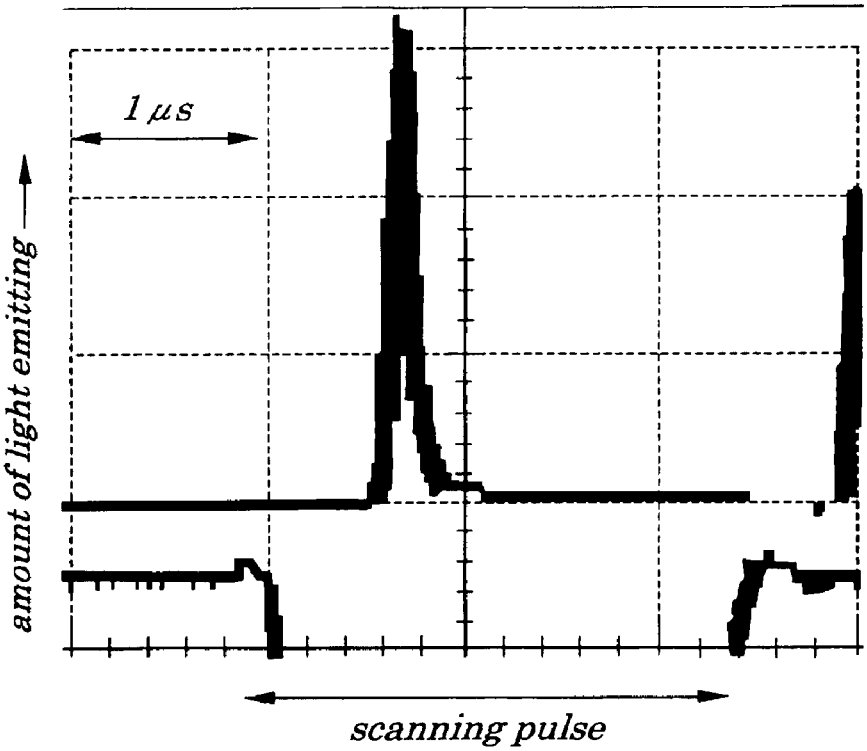
FIG. 4 is a diagram showing a relation between a scanning pulse and an amount of light emitted by discharge occurring when writing is done on the address-display separated-type AC PDP according to the first embodiment of the present invention.
Figure 5:
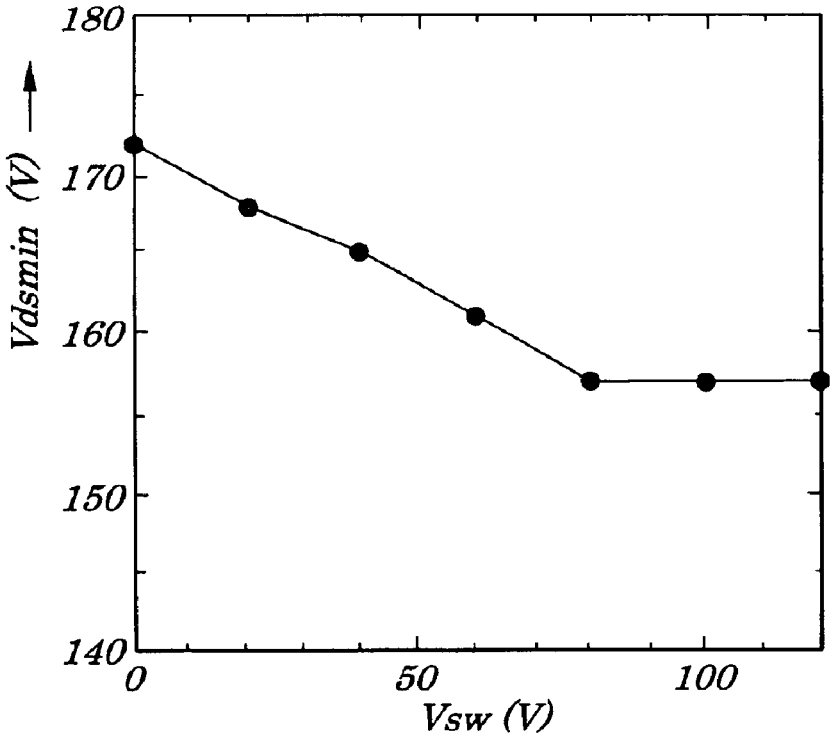
FIG. 5 is a diagram showing dependence of a minimum sustaining pulse voltage "Vdsmin" of a sustaining pulse on a writing wall charge forming pulse voltage "Vsw" employed in the address-display separated-type AC PDP according to the first embodiment of the present invention.
Figure 6:
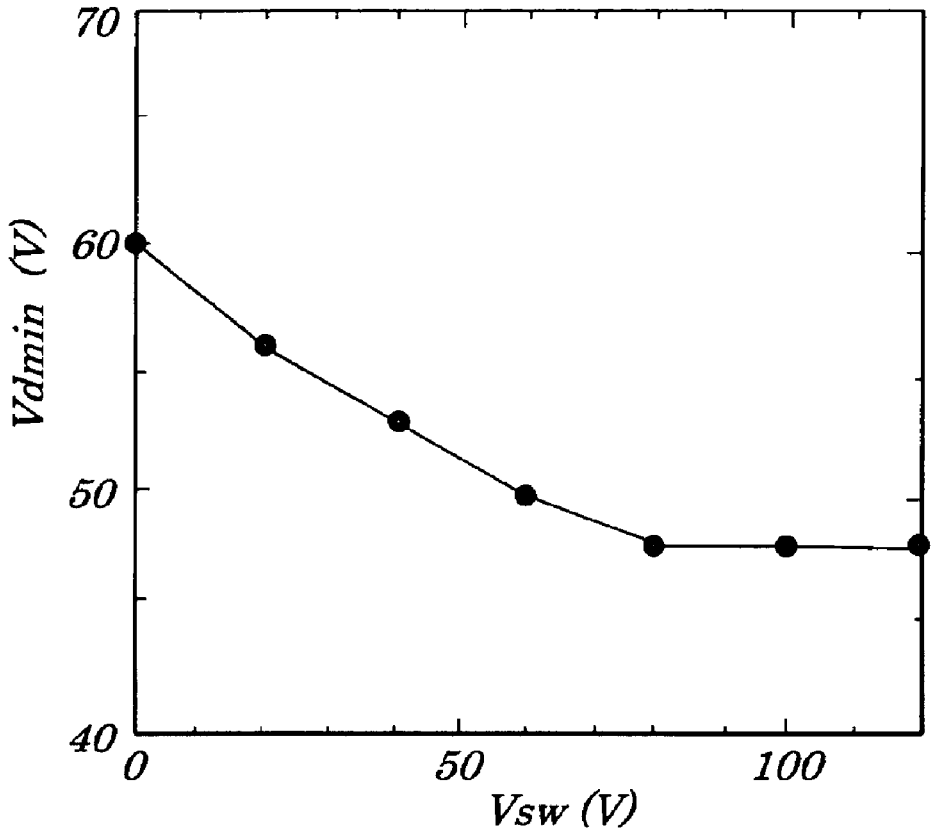
FIG. 6 is a diagram showing dependence of a minimum data pulse voltage "Vdmin" on the writing wall charge forming pulse voltage "Vsw" employed in the address-display separated-type AC DDP according to the first embodiment of the present invention.

FIG. 1 is a diagram illustrating configurations of a driving device of an address-display separated-type AC PDP according to a first embodiment of the present invention. FIG. 2 is a diagram showing driving waveforms of pulses to drive the address-display separated-type AC PDP according to the first embodiment. FIGS. 3A to 3E are diagrams illustrating shifts of states of wall charges formed when the address-display separated-type AC PDP is driven according to the first embodiment. FIG. 4 is a diagram showing a relation between a scanning pulse and an amount of light emitted by discharge occurring when writing is done on the address-display separated-type AC PDP according to the first embodiment. FIG. 5 is a diagram showing dependence of a minimum sustaining pulse voltage "Vdsmin" of a sustaining pulse on a writing wall charge forming pulse voltage "Vsw" employed in the address-display separated-type AC PDP according to the first embodiment. FIG. 6 is a diagram showing dependence of a minimum data pulse voltage "Vdmin" on the writing wall charge forming pulse voltage "Vsw" employed in the address-display separated-type AC DDP according to the first embodiment.

Figure 18:
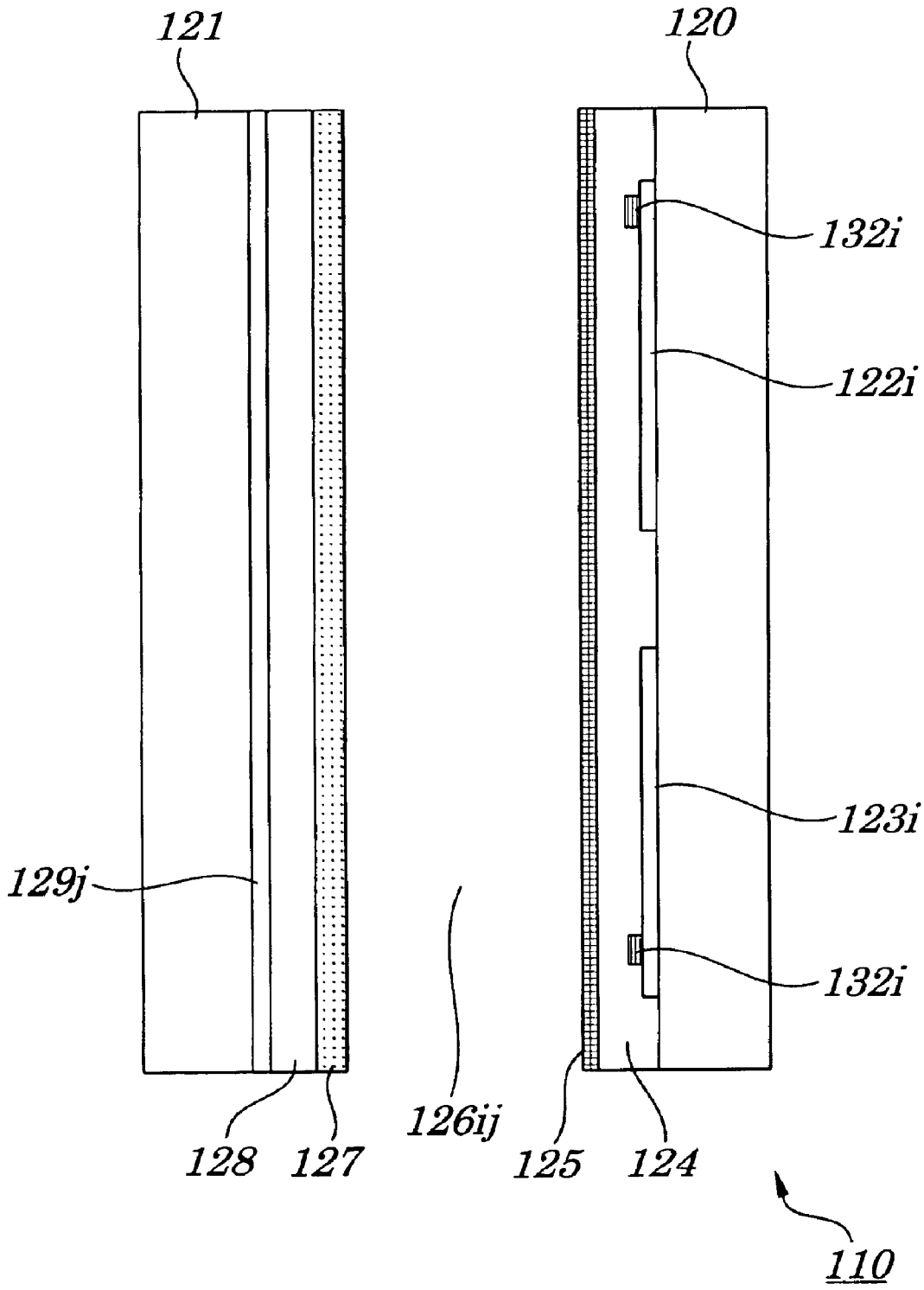
FIG.18 (PRIOR ART)
FIG. 18 is a diagram illustrating configurations of a conventional PDP.
Figure 19:
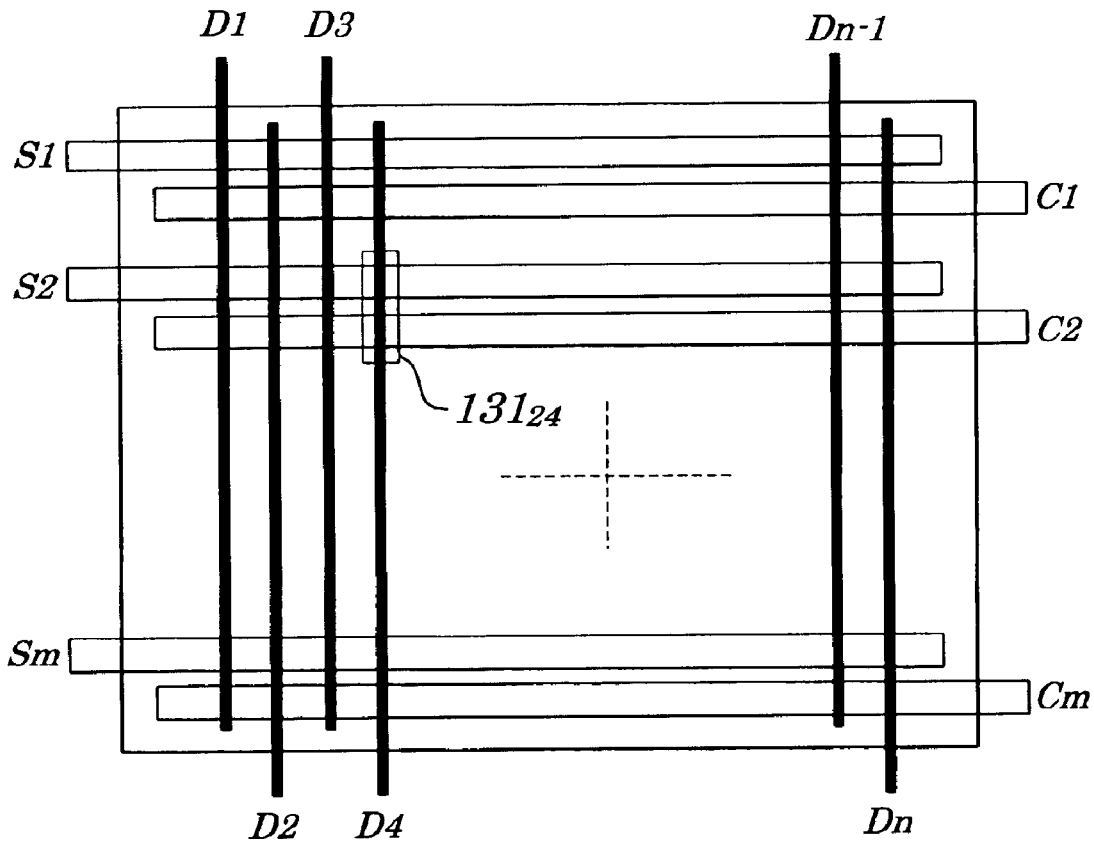
FIG.19 (PRIOR ART)
FIG. 19 is a diagram illustrating arrangements of each electrode in a conventional three-electrode AC-type PDP.

In the driving device 30 of the address-display separated-type AC PDP of the first embodiment, even if a width of a scanning pulse is shortened, only if writing discharge occurs once, sufficient wall charges are sequentially and continuously formed even when the PDP is driven at a low sustaining voltage and sustaining discharge can be sustained. Configurations of the address-display separated-type AC PDP (three-electrode AC-type PDP) of the embodiment are the same as those shown in FIG. 18. As shown in FIG. 1, the address-display separated-type AC PDP, as a whole, is configured by connecting the driving device 30 used to drive scanning electrodes, sustaining electrodes, and data electrodes to each of the scanning electrodes corresponding to each scanning line, each of the sustaining electrodes, and each of the data electrodes. For clarification of the drawing, data electrodes are not shown in FIG. 1.

Figure 20:
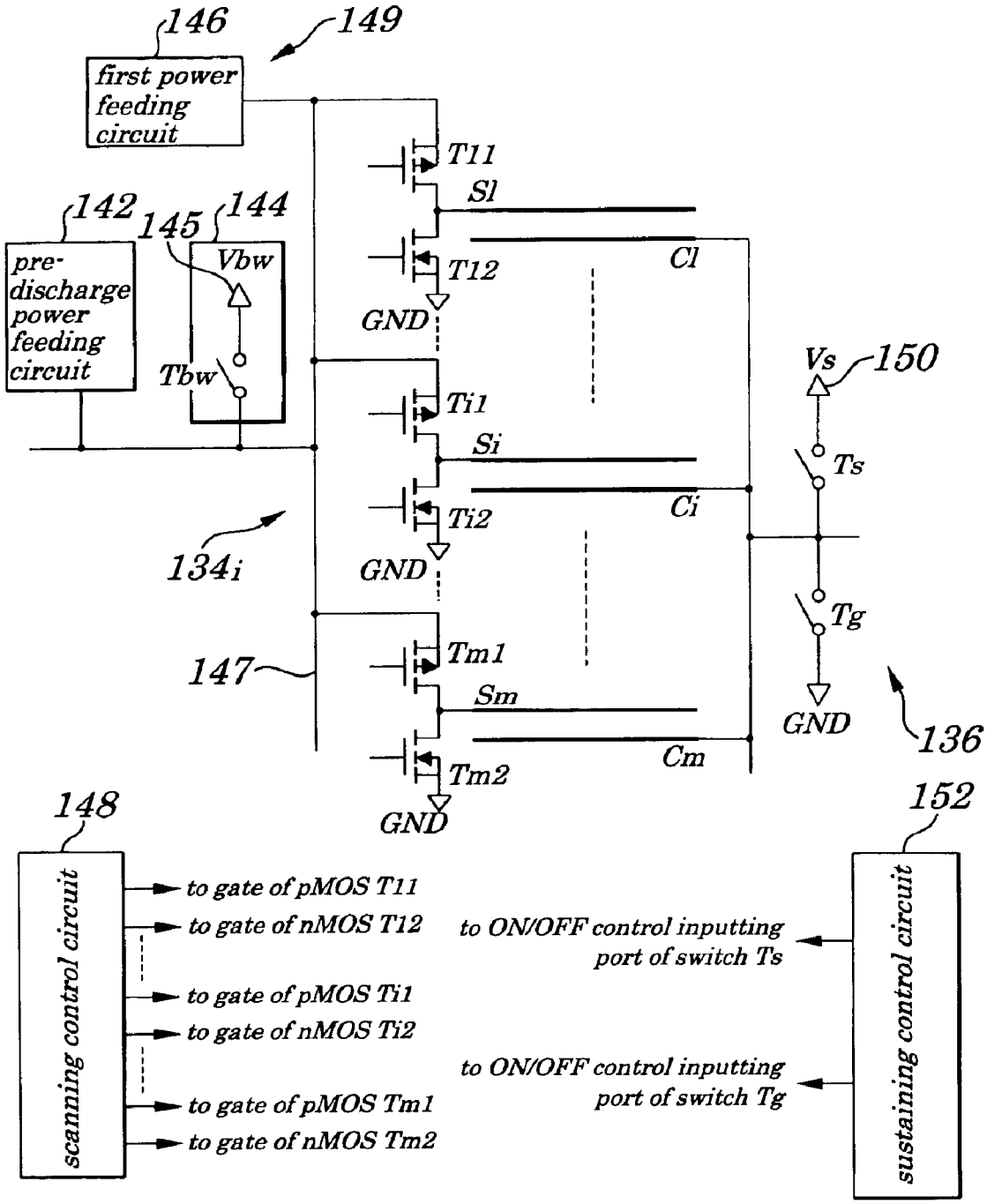
FIG.20 (PRIOR ART)
FIG. 20 is a diagram showing configurations of a driving circuit for a conventional three-electrode AC-type PDP.
Figure 21:
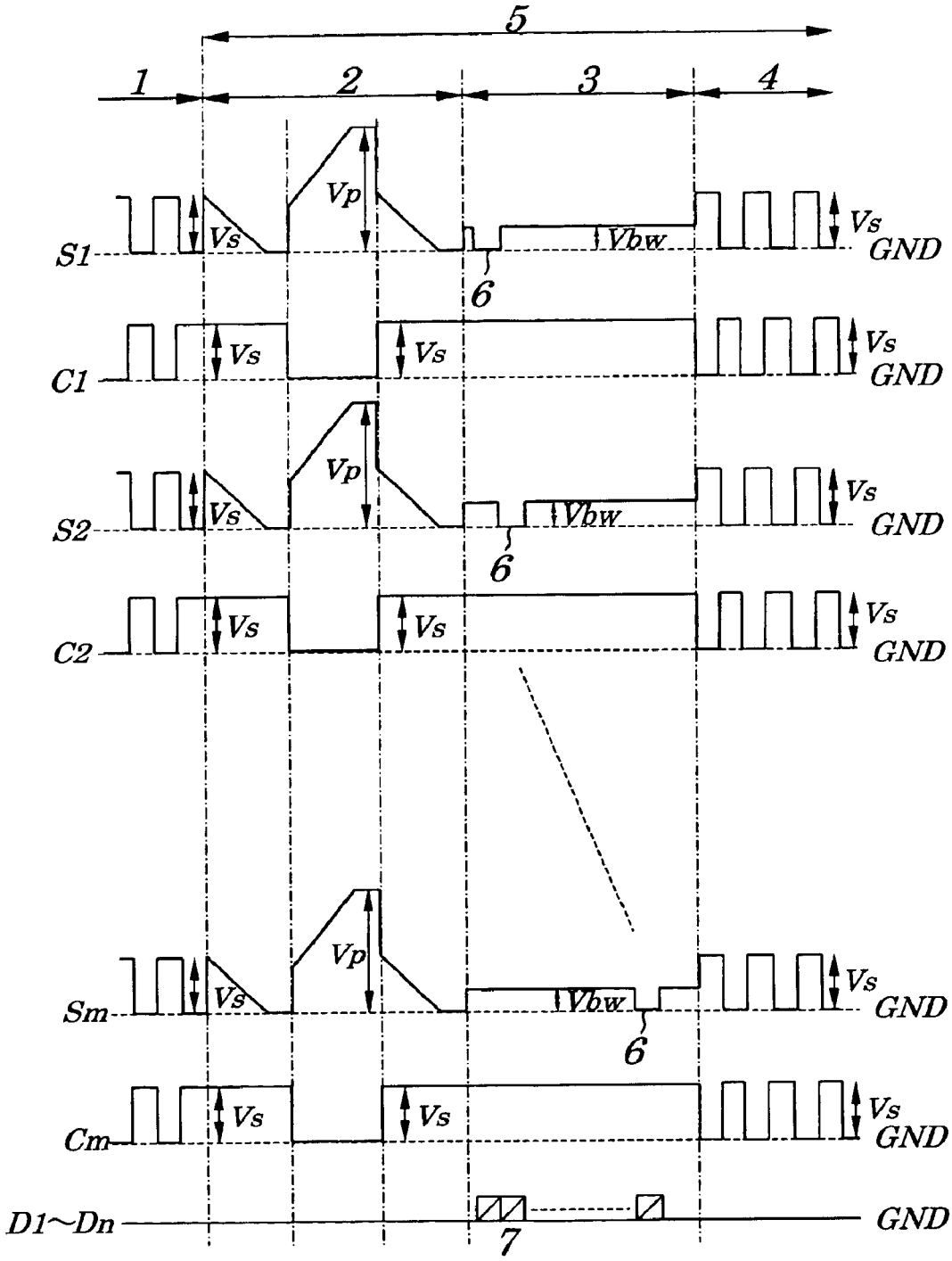
FIG.21 (PRIOR ART)
FIG. 21 is a diagram illustrating driving waves of pulses applied in the conventional three-electrode AC-type PDP.

The driving device 30, as shown in FIG. 1, is made up of a scanning driver 34*i* to drive the i-th scanning electrode Si (i=one of 1, 2, . . . , m) and a sustaining driver 36*i* to drive the i-th sustaining electrode Ci. Configurations and functions of the scanning driver 34*i* are the same as those of the scanning driver 134*i* shown in FIG. 20. The scanning driver 34*i*, as in the case shown in FIG. 20, is made up of a pre-discharge power feeding circuit 142, a scanning power feeding circuit 144, a pMOS Ti1, an nMOS Ti2, a first power feeding circuit 146, and a scanning control circuit 148. A sustaining driver 149 on a side where scanning operations are performed includes the pMOS Ti1, nMOS Ti2, first power feeding circuit 146, and scanning control circuit 148.

Operations of the sustaining driver 36*i* differ from those of the sustaining driver shown in FIG. 20 in that the sustaining driver 36*i* applies a voltage "Vsw+Vs" to the sustaining electrode Ci during a period from ending time of a scanning pulse applying period to a writing wall charge forming pulse applying period.

That is, the sustaining driver 36*i* is made up of a pMOS Ti3, an nMOS Ti4 whose drain is connected to a drain of the pMOS Ti3, a switch Ts connected through a line 38 to a source of the nMOS Ti4, and a switch Tg connected through the line 38 to the source of the nMOS Ti4, and a sustaining control circuit 40 connected to a gate of the pMOS Ti3, gate of the nMOS Ti4, ON/OFF control inputting port of the switch Ts, and ON/OFF control inputting port of the switch Tg through each of corresponding lines to exercise ON/OFF control on the pMOS Ti3, nMOS Ti4, switch Ts, and switch Tg.

The sustaining control circuit 40, during a pre-discharge period 2 and a sustaining period 4 in each sub-field, in the same control methods as used in the case of FIG. 20, feeds a control pulse to turn ON and OFF the switch Ts and the switch Tg to an ON/OFF control inputting port of the switch Ts and switch Tg and a control pulse to turn OFF the pMOS Ti3 to the gate of the pMOS Ti3 and a control pulse to turn ON the nMOS Ti4 to the gate of the nMOS Ti4.

Also, the sustaining control circuit 40, during a period from ending time of a scanning pulse applying period in the scanning period 3 in each sub-field to ending time of a writing wall charge forming pulse applying period, feeds a control pulse to turn ON the pMOS Ti3 to the gate of the pMOS Ti3, a control pulse to turn OFF the nMOS Ti4 to the gate of the nMOS Ti4 and also feeds, during a period other than a writing wall charge forming pulse applying period, a control pulse to turn OFF the pMOS Ti3 to the gate of the pMOS Ti3 and a control pulse to turn ON the nMOS Ti4 to the gate of the nMOS Ti4.

Next, operations of the AC-type PDP of the embodiment of the present invention are described by referring to FIGS. 1 to 4. As in the case of the conventional operation, when a sustaining period 1 in a previous sub-field ends, the pre-discharge period 2 in the present sub-field starts. The pre-discharge period 2 is used, as in the conventional case, to reset charges (wall charges) accumulated by sustaining discharge in the previous sub-field on a dielectric layer and to make priming discharge occur so that writing discharge occurs easily.

In descriptions below, operations commonly performed by the scanning electrode Si, sustaining electrode Ci, and data electrode Dj are explained by using a scanning electrode Sl, a sustaining electrode C1, and a data electrode D1 selected as a typical example. When an operation during the pre-discharge period 2 for the scanning electrode S1 in FIG. 2 starts, a first sawtooth-like wave signal, then a next sawtooth-like wave signal, and a last sawtooth-like wave signal are sequentially output from the pre-discharge power feeding circuit 142. At the same time when these sawtooth-like signals are output, a pMOS T11 is turned ON by the scanning control circuit 148 and an nMOS T12 are turned OFF by the scanning control circuit 148 and the first sawtooth-like wave signal, the next sawtooth-like wave signal, and the last sawtooth-like wave signal are applied sequentially to the scanning electrode S1.

Wall charges formed during the sustaining period 1 in a previous sub-field are reset by the first sawtooth-like signal to be applied to the scanning electrode S1. Priming discharge occurs by the next sawtooth-like wave signal and wall charges formed by the priming discharge are adjusted.

A state of wall charges occurring after the resetting during the pre-discharge period 2 has been complete and the priming discharge operations have been performed and the scanning period 3 has started and before a scanning pulse is applied, as in the conventional case, is put into a state in which writing discharge can occur at a potential difference being a data pulse voltage "Vd". As a result, a state as shown in FIG. 3A occurs in which negative wall charges are accumulated on the scanning electrode S1 and positive wall charges on the data electrode D1.

Writing operations are the same as those performed in the conventional case. That is, occurrence or non-occurrence of writing discharge is determined depending on whether or not a data pulse 7 is applied while a scanning pulse 6 is being applied. Writing is done when the writing discharge occurs. This operation is described more specifically below. When the scanning period 3 starts, a switch Tbw in the scanning power feeding circuit 144 is turned ON by the scanning control circuit 148 and a voltage "Vbw" is fed from the scanning power feeding circuit 144 and, during a scanning pulse applying period, the pMOS T11 is turned OFF and the nMOS T12 is turned ON and the scanning pulse 6 is applied to the scanning electrode S1.

When the scanning pulse 6 is applied to the scanning electrode Sl, if the data pulse 7 is not applied to the data electrode D1, even if a voltage of a data pulse for the data electrode D1 is superimposed on a wall voltage being a voltage applied to dielectric layers 125 and 128 by wall charges, since a surface firing voltage or more is not applied to a facing discharge gap portion in discharge space $\mathbf{126}_{11}$ between the scanning electrode S1 and data electrode D1, writing discharge does not occur.

When the scanning pulse 6 is applied to the scanning electrode S1, if the data pulse 7 is fed to the data electrode D1, since a negative wall voltage at the scanning electrode S1 and a positive wall voltage at the data electrode D1 are further superimposed on a voltage of the data pulse 7, a voltage being applied to the facing discharge gap portion in the discharge space $\mathbf{126}_{11}$ exceeds the surface firing voltage, thus causing writing discharge to occur in the facing discharge gap portion in the discharge space $\mathbf{126}_{11}$. When the writing discharge has occurred, as shown in FIG. 3B, charges are moved and positive wall charges are formed on the scanning electrode Si and negative wall charges are formed on the data electrode D1. At the same time as the formation of the wall charges, space charges moves also between the scanning electrode Si and sustaining electrode C1 (that is, between surface electrodes) by an electric field generated between these electrodes, thus causing negative wall charges to be formed on the sustaining electrode C1.

When images with high definition are displayed on a PDP, a method in which a width of a scanning pulse is shortened is employed, as described above, there appears a tendency in which easy formation of positive wall charges on the scanning electrode S1 and negative wall charges on the sustaining electrode C1 becomes difficult, which causes uncertain sustaining discharge to occur and a display cell to be not lit and/or a flicker to occur. However, according to the present invention, since a writing wall charge forming pulse 8 is applied to the sustaining electrode C1, positive wall charges and negative wall charges can be formed successfully on the scanning electrode S1 and on the sustaining electrode C1 respectively, which enables sustaining discharge to occur in a sustained manner. These operations are explained in detail below.

In the conventional driving method, when application of a scanning pulse is terminated, since a potential of the scanning electrode S1 is boosted to be "Vbw", a potential difference between the scanning electrode S1 and sustaining electrode C1 decreases greatly from "Vs" to "Vs−Vbw". However, according to the present invention, during a period from time of termination of the application of a scanning pulse to ending time of the writing wall charge forming pulse applying period, a control pulse is applied from the sustaining control circuit 40 to a gate of a pMOS T13 in the sustaining driver $\mathbf{36}_i$ to turn ON the pMOS T13 and, during the writing wall charge forming pulse applying period, a control pulse is fed from the sustaining control circuit 40 to a gate of an nMOS T14 to turn OFF the nMOS T14. The writing wall charge forming pulse applying period during which the writing wall charge forming pulse 8 is applied includes both the period necessary for formation of wall charges at time of writing, that is, a period during which wall charges are formed by movements of space charges after the end of a pulse application period during which a scanning pulse is applied and a period during which no erroneous discharge occurs.

Thus, since the writing wall charge forming pulse 8 is applied to the sustaining electrode C1 during the writing wall charge forming pulse applying period, during a period from the time of termination of the application of a scanning pulse to ending time of the writing wall charge forming pulse applying period, a potential difference between the scanning electrode S1 and sustaining electrode C1 continues to be "Vs+Vsw−Vbw" and a voltage being higher by "Vsw" than that employed in the conventional driving method is applied between the scanning electrode S1 and sustaining electrode C1.

Figure 3D:
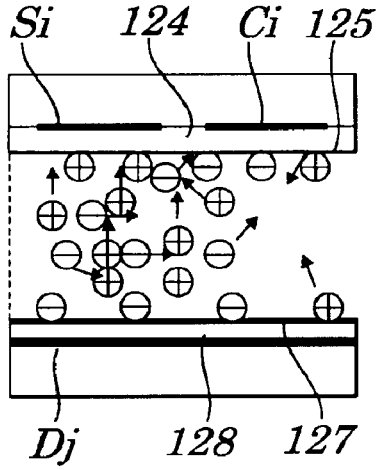
Figure 3E:
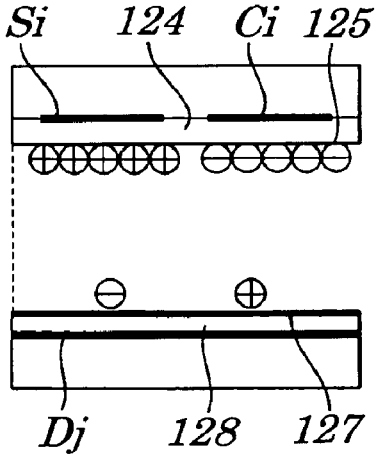

As a result, even after termination of the application of the scanning pulse, movements of space charges between the surface electrodes continue and at time of termination of the application of the writing wall charge forming pulse 8, large amounts of positive wall charges are accumulated on the scanning electrode S1 as shown in FIG. 3D and large amounts of negative wall charges on the sustaining electrode C1 as shown in FIG. 3E, in the end.

At the time of termination of the application of the writing wall charge forming pulse 8, in a state in which large amounts of positive wall charges have been accumulated on the scanning electrode S1 and large amounts of negative wall charges on the sustaining electrode C1, operations can start in the sustaining period 4. During the sustaining period 4, as in the conventional driving method, only when writing discharge occurs during the scanning period 3, large amounts of positive wall charges are formed in the vicinity of a surface discharge gap of the scanning electrode S1 and negative wall charges are formed in the vicinity of a surface discharge gap of the sustaining electrode C1 and, therefore, sustaining discharge occurs and a display cell is lit. Thus, lighting and non-lighting of the display cells can be controlled.

Next, set values of each of pulse voltages and set application time of each signal are described. During the pre-discharge period, "Vs" and "Vp" are set to be 160 V and 380 V, respectively, and a width of a slope of each sawtooth-like wave is set to be about 50 μsec. During the scanning period, "Vs" and "Vbw" are set to be 160 V and 110 V, respectively, and a width of the scanning pulse is set to be 1 μsec and a ground potential is used as a low voltage.

The writing wall charge forming pulse to be applied during the scanning period is set as follows. That is, when a pulse width of the writing wall charge forming pulse 8 is made longer from 0 μsec and exceeds about 2 μsec, both a voltage value "Vdsmin" being a minimum sustaining pulse that normally operated and a voltage value "Vdmin" being a minimum data pulse that normally operated begin to decrease rapidly and then until the pulse width becomes between 2 μsec to 3 μsec, tend to decrease gradually. Thereafter, even if the pulse width is made further longer, neither the voltage value "Vdsmin" being a minimum sustaining pulse nor the voltage value "Vdmin" being a minimum data pulse changes. When the pulse width of the writing wall charge forming pulse 8 is made longer, erroneous discharge occurs easily. Therefore, if the pulse width of the writing wall charge forming pulse 8 is made longer than necessary, a pulse voltage can not be made high. Thus, in the embodiment of the present invention, the pulse width of the writing wall charge forming pulse 8 is set to be 3 μsec to 5 μsec and the pulse voltage is set to be 40 V to 120 V. The pulse voltage reaching about 140 V causes erroneous discharge to occur and, therefore, application of the pulse voltage exceeding the 140 V is not allowed.

A potential of the sustaining electrode C1 occurring when the writing wall charge forming pulse 8 is not applied is not necessarily set to be a sustaining pulse voltage value "Vs", however, by setting the potential to be a voltage at which erroneous discharge does not occur between the scanning electrode S1 and sustaining electrode C1 at time of writing and to be as high as possible, negative wall charges can be formed easily on the sustaining electrode C1 when writing is done. In the embodiment, in order to use the power source in a shared manner, a potential of the sustaining electrode C1 occurring when the writing wall charge forming pulse 8 is not applied is set to be a sustaining pulse voltage "Vs".

Next, effects obtained by applying the writing wall charge forming pulse 8 to the sustaining electrode C1 are described more specifically. FIG. 4 shows a discharge delay characteristic of a display cell employed in the embodiment and which is obtained by overlaying light-emitting waveforms produced by discharge for writing one hundred times. As shown in FIG. 4, discharge occurs after some periods have elapsed since a voltage was applied. There are variations in the elapsed time. If the period during which writing discharge surely occurs by one hundred time writing operations is defined as discharge delay time, in the embodiment, the discharge delay time in the display cell is read as 0.8 μsec. Therefore, when a scanning pulse having a pulse width of 1 μsec is applied, writing discharge occurs.

This relation is compared with that employed in the conventional driving method. That is, in the conventional driving method, when a pulse width of a scanning pulse is set to be 1 μsec, even if a sustaining pulse of 170 V is applied, lighting in a display cell did not occur. However, according to the driving method employed in the present invention, when the pulse width of the scanning pulse is set to be 1μsec, as in the conventional case, and a voltage value "Vsw" of a writing wall charge forming pulse is set at 80 V, a display cell can be lit at the sustaining pulse voltage "Vs" being 160 V.

As is apparent from the above description, in the driving method of the present invention, a sustaining pulse voltage value "Vs" is allowed to be decreased. FIG. 5 shows results obtained by measuring a degree of dependence of a minimum sustaining pulse voltage value "Vdsmin" at which normal operations can be performed on a writing wall charge forming pulse voltage value "Vsw" (dependence of "Vdsmin" to "Vsw"). A case of "Vsw"=0 corresponds to the conventional driving waveform. When the voltage "Vsw" is increased, the voltage "Vdsmin" is decreased and, when the "Vsw"=about 80 V, the decrease stops.

Also, according to the driving method of the present invention, it is possible to let a data pulse voltage value "Vd" be decreased. FIG. 6 shows results obtained by measuring a degree of dependence of a minimum data pulse voltage value "Vdmin" at which normal operations can be performed on a writing wall charge forming pulse voltage value "Vsw" (dependence of "Vdmin" to "Vsw"). In this case, also, when the Vsw=about 80 V, the decrease effect of the data pulse voltage value is saturated.

This means that, by setting a writing wall charge forming pulse voltage value "Vsw" to be 80 V or more, the effect obtained by applying a pulse can be maximized. Thus, in a display cell of the present invention, if the "Vsw" is lowered to be 80 V, the effect by increasing the voltages "Vdsmin" or "Vdmin" using the writing wall charge forming pulse can be fully obtained. That is, by applying a potential difference exceeding a specified level between the scanning electrode and sustaining electrode for a specified period following termination of application of the scanning pulse, movements of charges are made to continue even after the application of the scanning pulse and, as a result, large amounts of wall charges can be formed between the scanning electrode and sustaining electrode.

This is described by using the concrete examples in the embodiment. That is, in the embodiment, "Vs"=160 V, "Vbw"=110 V, and "Vsw"=80 V and, therefore, after the termination of application of the scanning pulse, a voltage of 130 V is applied between the scanning electrode and sustaining electrode. In the state in which no wall charges exist between surface electrodes of the embodiment, since a surface firing voltage being a minimum potential difference at which discharge starts is about 190 V, the above voltage of 130 V makes up approximately two-thirds of 190 V being the surface firing voltage. Moreover, this voltage, as is apparent from the above description, is applied for a period during which no erroneous discharge occurs between the scanning electrode and sustaining electrode.

Thus, according to the embodiment, in the method for driving the address-display separated-type AC PDP, when a scanning pulse applying period starts, by applying a scanning pulse to the scanning electrode to which the voltage of "Vbw"=100 V and by applying a data pulse which is to be applied in synchronization with a scanning pulse to the data electrode, writing discharge occurs between the scanning electrode and data electrode in the display cell of the embodiment and positive wall charges are formed on the scanning electrode and negative wall charges on the sustaining electrode.

By applying, after the termination of application of the scanning pulse, a writing wall charge forming pulse having a voltage being higher by a voltage "Vsw" being 80 V than the voltage "Vs" being 160 V being applied to the sustaining electrode, further movements of space charges between the scanning electrode and sustaining electrode are made to continue so that positive wall charges sufficiently enough to make sustaining discharge occur are accumulated on the scanning electrode and sufficient negative wall charges are accumulated on the sustaining electrode and so that these wall charges having both a positive polarity and negative polarity, as in the conventional case, are exchanged among the scanning electrode, sustaining electrode, and sustaining electrode to turn ON a display cell. Therefore, it is possible to successfully solve technical problems occurring when a method by which an increase in a scanning period occurring when images with high definition are displayed is accommodated by shortening a period of applying a scanning pulse is employed, that is, technical problems that, though an increase in a minimum sustaining pulse voltage value "Vdsmin" at which normal operations can be performed and/or a minimum data pulse voltage value "Vdmin" at which normal operations can be performed can be suppressed, prevention of a voltage of a sustaining pulse and data pulse from becoming high cannot be easily achieved and accumulation of wall charges sufficiently enough to make sustaining discharge occur at time of terminating the application of the scanning pulse is difficult. Since the sustaining pulse and data pulse can be prevented from becoming high in voltage, power consumption can be reduced and a low-cost driver that cannot withstand comparatively high voltages is usable which reduces costs. Since such the effect as described above can be achieved, a shift of operations to reliable occurrence of sustaining discharge is made possible, which prevents no lighting of a display cell and/or occurrence of flickering in displaying.

SECOND EMBODIMENT

Figure 7:
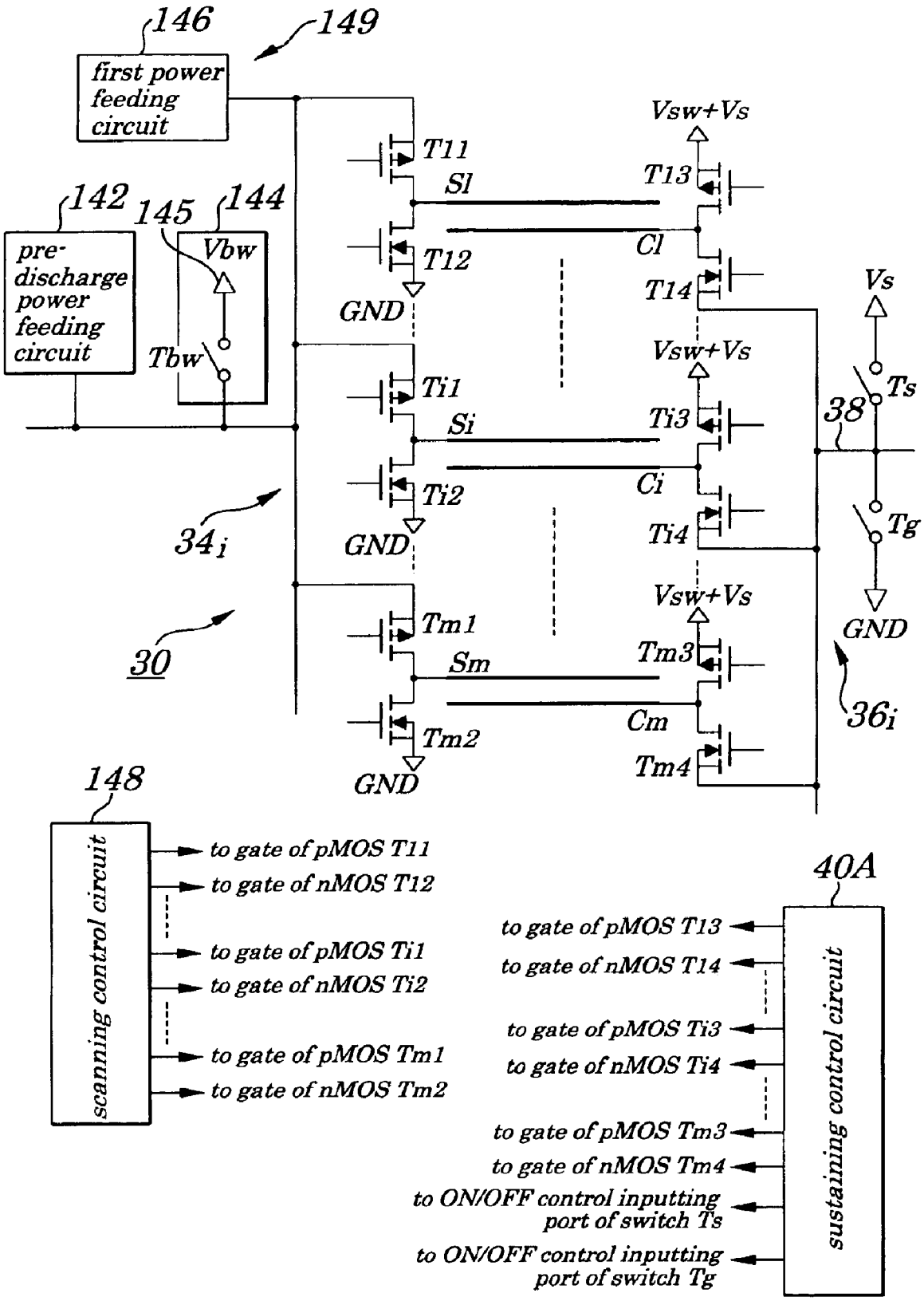
FIG. 7 is a diagram illustrating configurations of a driving device of an address-display separated-type AC PDP according to a second embodiment of the present invention.
Figure 8:
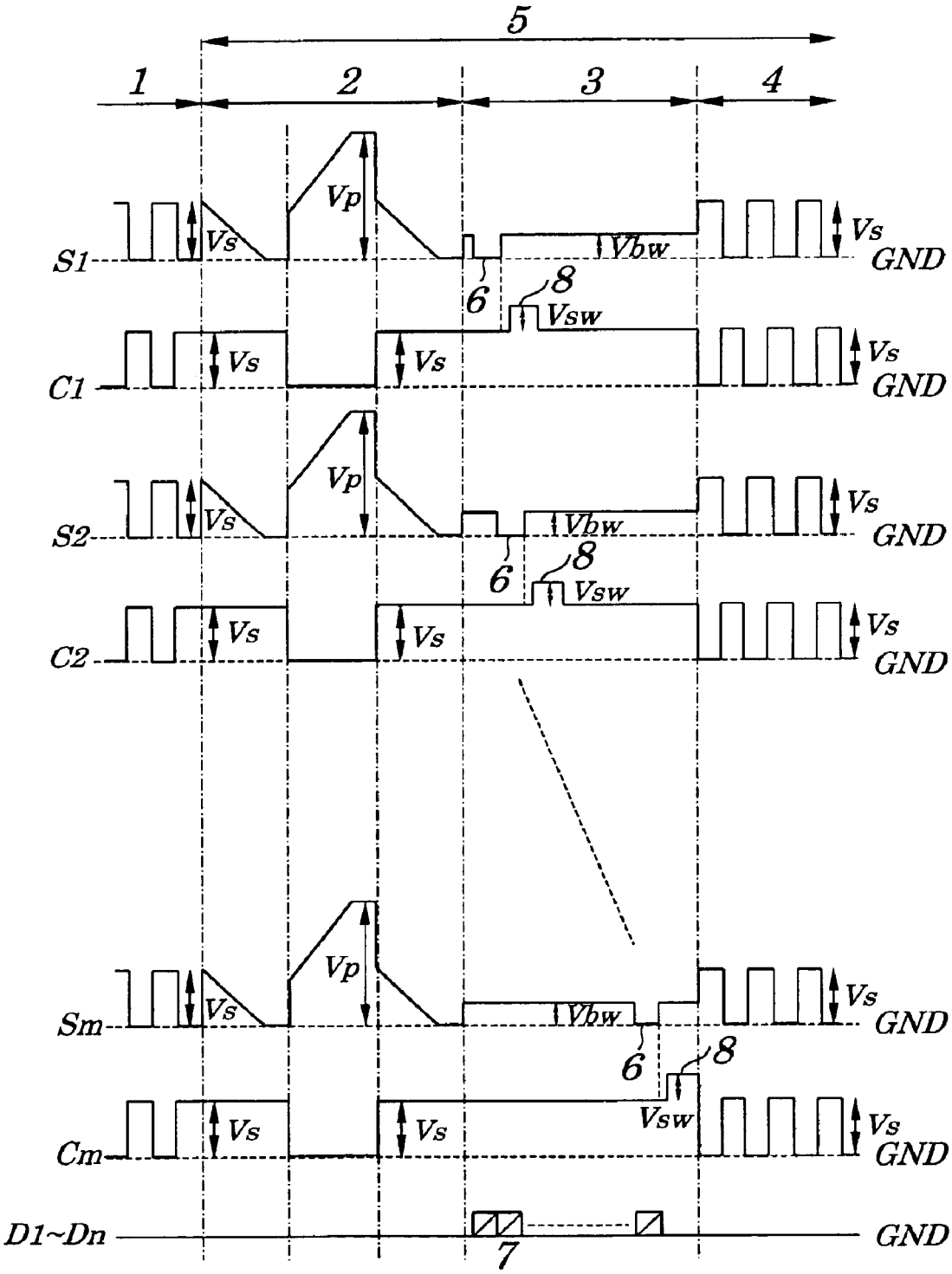
FIG. 8 is a diagram showing driving waveforms of pulses to drive the address-display separated-type AC PDP according to the first embodiment of the present invention.
Figure 9A:
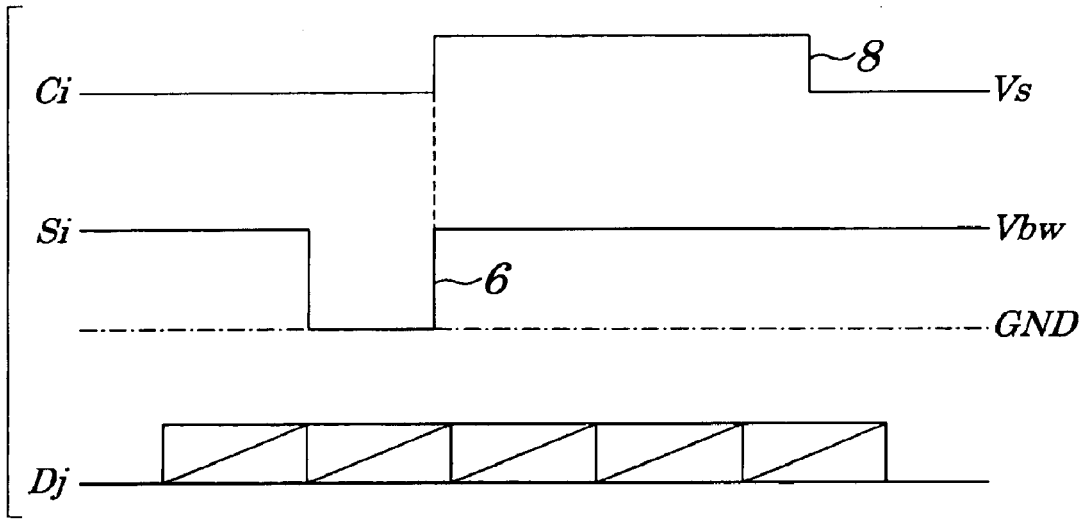
FIGS. 9A and 9B are expanded views of driving waveforms of a scanning pulse and of other pulses to be applied in the address-display separated-type AC PDP according to the second embodiment of the present invention.
Figure 9B:
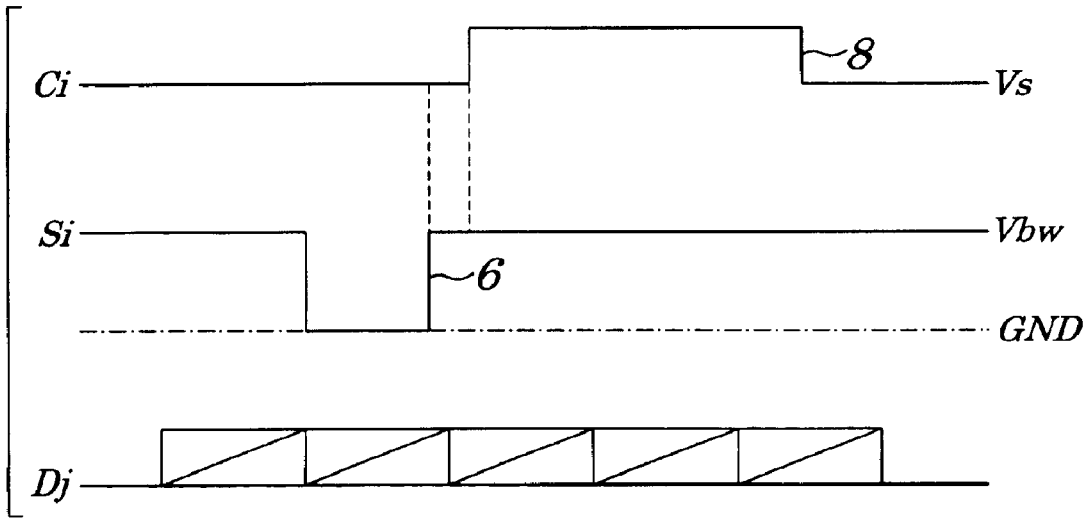

FIG. 7 is a diagram illustrating configurations of a driving device of an address-display separated-type AC PDP according to a second embodiment of the present invention. FIG. 8 is a diagram showing driving waveforms of pulses to drive the address-display separated-type AC PDP according to the first embodiment. FIGS. 9A and 9B are expanded views of driving waveforms of a scanning pulse and of other pulses to be applied in the address-display separated-type AC PDP according to the second embodiment. The driving method of the second embodiment differs from that of the first embodiment in that a writing wall charge forming pulse is applied to a sustaining electrode after a specified period has elapsed since termination of application of a scanning pulse.

That is, a sustaining control circuit 40A shown in FIG. 7 feeds a control pulse to turn ON a pMOS Ti3 to a gate of the pMOS Ti3 for a specified period following time of termination of a scanning pulse applying period within a scanning period in each of sub-fields, that is, for a writing wall charge forming pulse applying period after 0.2 μsec to 0.4 μsec have elapsed and a control pulse to turn ON a nMOS Ti4 to a gate of the nMOS Ti4, while the sustaining control circuit 40A, for a period other than the writing wall charge forming pulse applying period within the scanning period 3 in each subfield, feeds a control pulse to turn OFF the pMOS Ti3 to the gate of the pMOS Ti3 and a control pulse to turn ON the nMOS Ti4 to the gate of the nMOS Ti4. Configurations of each component of the second embodiment are the same as those in the first embodiment except the difference described above and same reference numbers are assigned to components having the same function as those in the first embodiment and their descriptions are omitted accordingly.

Next, operations of the driving device of the embodiment are described by referring to FIG. 7 to FIGS. 9A and 9B. Operations to be performed before a scanning pulse applying period ends are the same as those in the first embodiment. In the second embodiment, a writing wall charge forming pulse is applied to a sustaining electrode Ci not at the same time as ending time of the scanning pulse applying period but after a specified period. Operations of a first scanning electrode S1, first sustaining electrode C1, and first data electrode D1 are explained below.

After a specified period has elapsed following ending time of the scanning pulse applying period, a control pulse is applied from the sustaining control circuit 40A to the gate of the pMOS Ti3 in the sustaining driver 36$_i$ for a writing wall charge forming pulse applying period to turn ON the pMOS Ti3 and a control pulse is applied from the sustaining control circuit 40A to the gate of the nMOS Ti4 for a writing wall charge forming pulse applying period to turn OFF the nMOS Ti4.

As a result, a writing wall charge forming pulse 8 (see C1 in FIG. 8) is applied to the sustaining electrode C1 after a specified period has elapsed following the ending time of the scanning pulse applying period. This is illustrated in FIG. 9B. FIG. 9A shows the state in the first embodiment. If a time interval of 2 μsec or more is provided between the scanning pulse 6 and the writing wall charge forming pulse 8, space charges in a display cell 131*ij* are decreased by writing discharge and even if the writing wall charge forming pulse 8 is applied then, no new wall charges are formed and, as a result, the effect of suppressing an increase in a voltage value of a sustaining pulse or of a data pulse is almost lost. Moreover, the writing wall charge forming pulse period during which a writing wall charge forming pulse 8 is applied is the same as employed in the first embodiment.

Then, since the writing wall charge forming pulse 8 whose amplitude is "Vs+Vsw" is applied to the sustaining electrode C1 during the writing wall charge forming pulse applying period, a potential difference becomes "Vs+Vsw−Vbw" during the writing wall charge forming pulse applying period following the ending time of the scanning pulse applying period, a voltage being higher by a voltage "Vsw" than that employed in the conventional method is applied to the scanning electrode S1 and sustaining electrode C1.

As a result, even after termination of the application of the scanning pulse, movements of space charges between surface electrodes continue (see FIG. 3D) and, at time of termination of the application of the writing wall charge forming pulse 8, large amounts of positive wall charges are accumulated on the scanning electrode S1 and large amounts of negative wall charges are amounted on the sustaining electrode C1 (FIG. 3E), in the end.

Concrete set values for the writing wall charge forming pulse producing accumulation effects of wall charges are the same as those employed in the first embodiment. The effects produced by the writing wall charge forming pulse in that case are the same as those employed in the first embodiment shown in FIGS. 5 and 6. This indicates that, by applying a potential difference having a specified level or more to a scanning electrode and sustaining electrode for a specified period after termination of the application of a scanning pulse, movements of charges continues and large amounts of wall charges are formed on the scanning electrode and sustaining electrode.

In a state in which large amounts of positive wall charges are accumulated on the scanning electrode S1 and large amounts of negative wall charges on the sustaining electrode C1 at time of termination of the application of the writing wall charge forming pulse 8, operations start in the sustaining period 4. In the sustaining period 4, as in the conventional method, only when writing discharge occurred during the scanning period 3, large amounts of positive wall charges have been formed in the vicinity of the surface discharge gap on the scanning electrode S1 and large amounts of negative wall charges in the vicinity of the surface discharge gap on the sustaining electrode C1 and therefore sustaining discharge occurs and a display cell is put into a light-emitting state.

Thus, according to the driving method of the embodiment, by applying, from a lapse of time of less than 2 μsec after the ending time of the scanning pulse applying period, a writing wall charge forming pulse to a sustaining electrode in the conventional driving method for the address-display separated-type AC PDP, the same effects as obtained in the first embodiment can be achieved in the present embodiment.

THIRD EMBODIMENT

Figure 10:
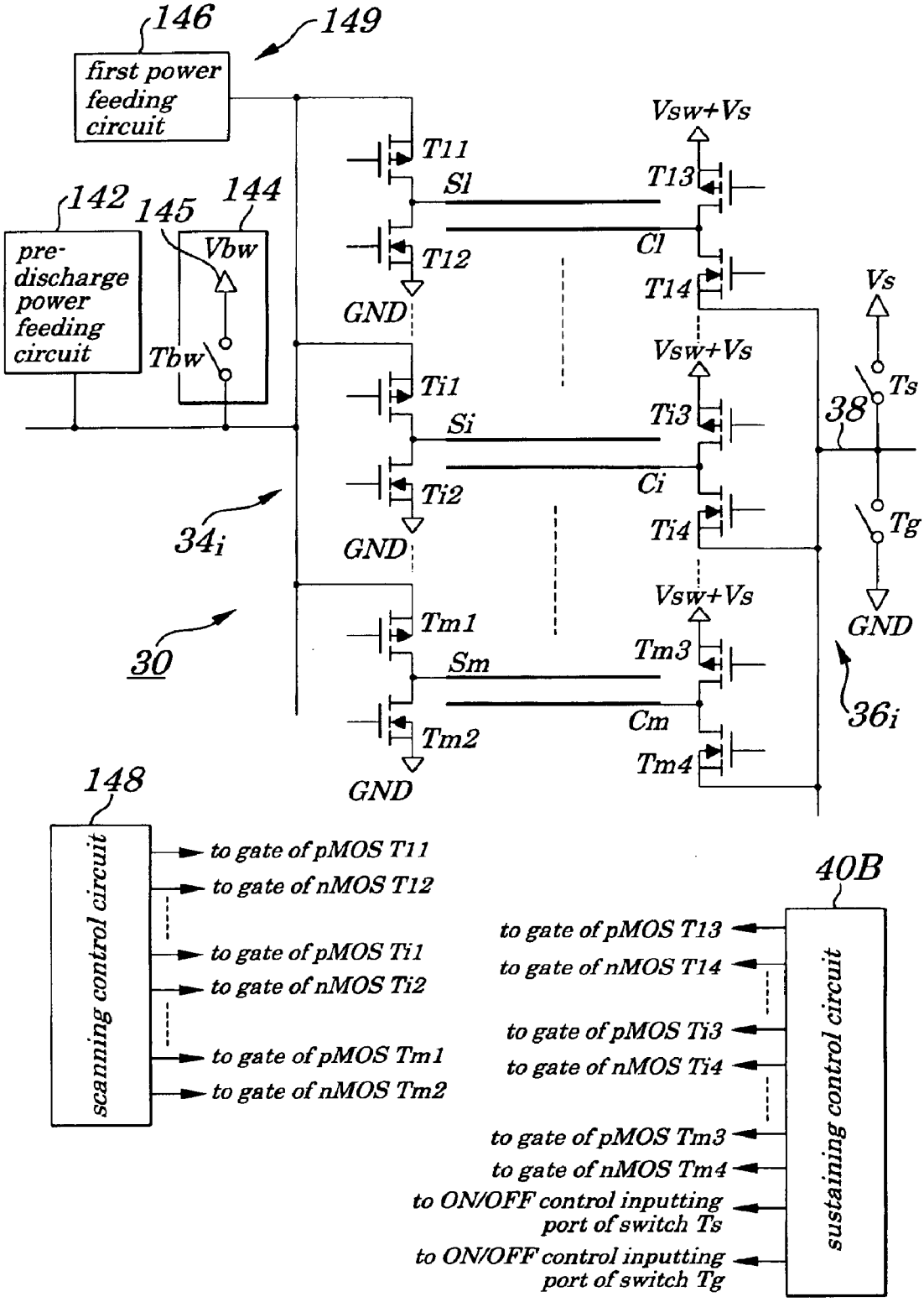
FIG. 10 is a diagram illustrating configurations of a driving device of an address-display separated-type AC PDP according to a third embodiment of the present invention.
Figure 11:
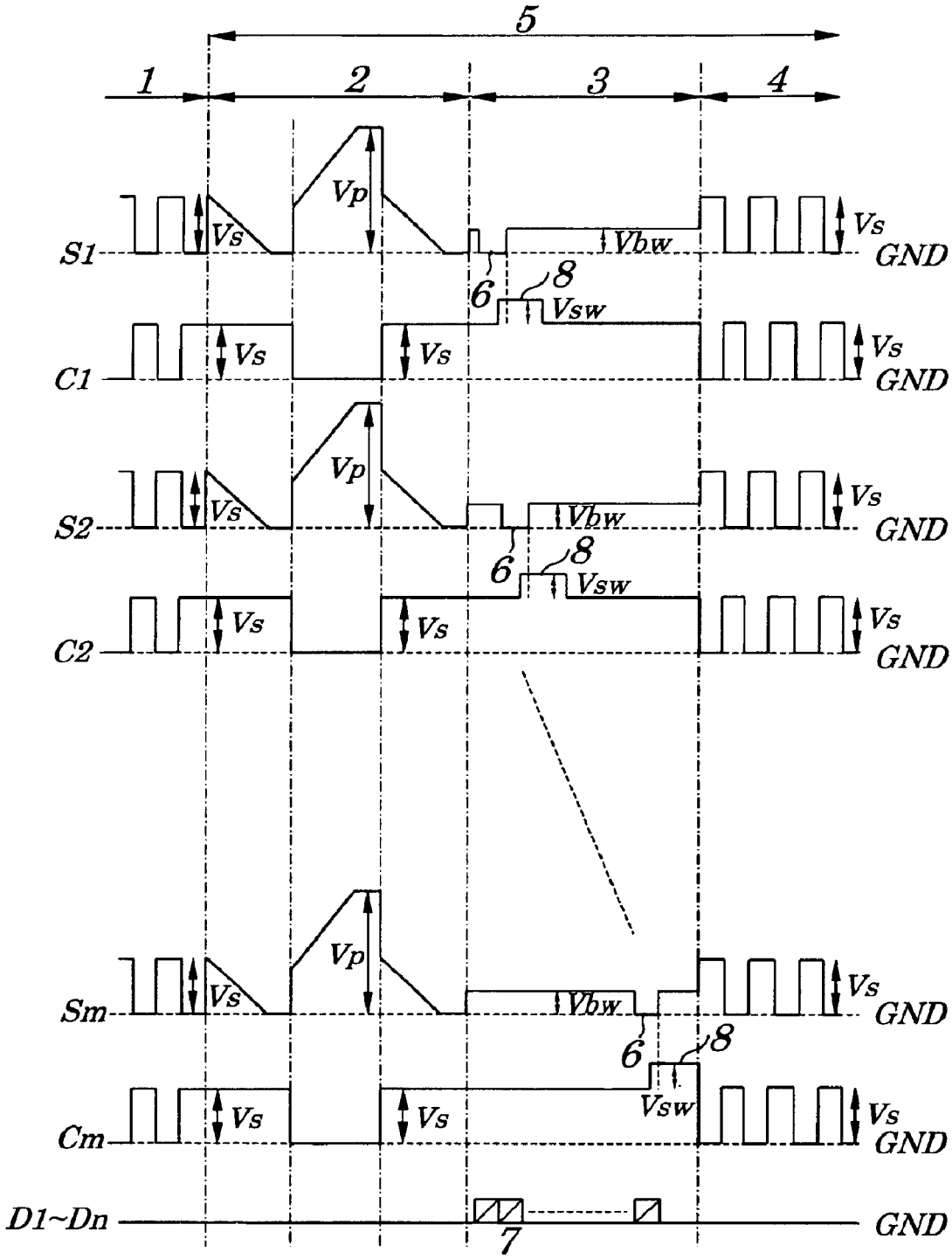
FIG. 11 is a diagram showing driving waveforms of pulses to drive the address-display separated-type AC PDP according to the third embodiment of the present invention.
Figure 12A:
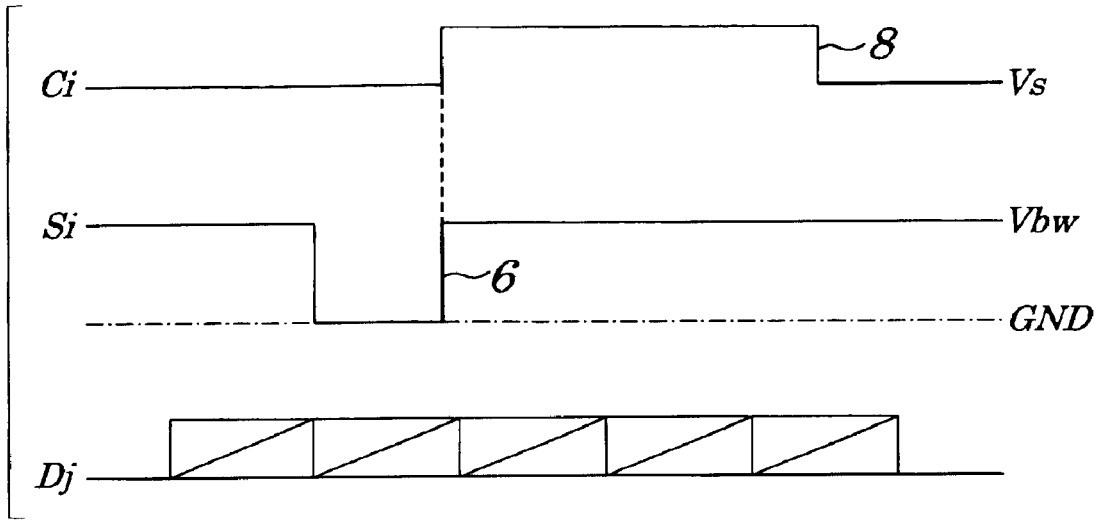
FIGS. 12A and 12B are expanded views of driving waveforms of a scanning pulse and of other pulses to be applied in the address-display separated-type AC PDP according to the third embodiment of the present invention.
Figure 12B:
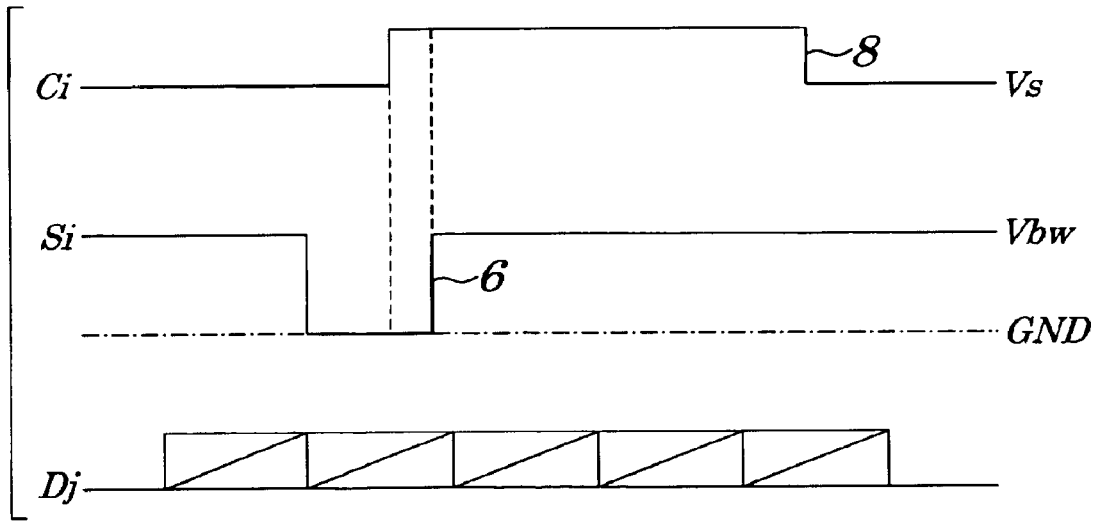

FIG. 10 is a diagram illustrating configurations of a driving device of an address-display separated-type AC PDP according to a third embodiment of the present invention. FIG. 11 is a diagram showing driving waveforms of pulses to drive the address-display separated-type AC PDP according to the third embodiment. FIGS. 12A and 12B are expanded views of driving waveforms of a scanning pulse and of other pulses to be applied in the address-display separated-type AC PDP according to the third embodiment. Operations employed in the third embodiment differ from those employed in the first embodiment in that a writing wall charge forming pulse is applied to a sustaining electrode from specified time before termination of the application of the scanning pulse.

That is, a sustaining control circuit 40B shown in FIG. 10 feeds a control pulse to turn ON a pMOS Ti3 to a gate of the pMOS Ti3 from specified time before ending of a scanning pulse applying period in a scanning period 3 in each of sub-fields, that is, for a writing wall charge forming pulse applying period from 0.2 μsec to 0.5 μsec before and a control pulse to turn OFF an nMOS Ti4 to a gate of the nMOS Ti4, while the sustaining control circuit 40A, for a period other than the writing wall charge forming pulse applying period in the scanning period 3 in each sub-field, feeds a control pulse to turn OFF the pMOS Ti3 to the gate of the pMOS Ti3 and a control pulse to turn ON the nMOS Ti4 to the gate of the nMOS Ti4. Configurations employed in the third embodiment are the same as those employed in the first embodiment except the difference described above and same reference numbers are assigned to components having the same function as those in the first embodiment and their descriptions are omitted accordingly.

Next, operations of the driving device are described by referring to FIG. 10 to FIGS. 12A and 12B. Operations to be performed before a scanning pulse applying period ends are the same as those in the first embodiment. In the third embodiment, a writing wall charge forming pulse is applied from specified time before ending time of the scanning pulse applying period. Operations of a first scanning electrode S1, first sustaining electrode Cl, and first data electrode D1 are explained.

From specified time before ending of the scanning pulse applying period, a control pulse is applied from the sustaining control circuit 40B to the gate of the pMOS Ti3 in the sustaining driver 36, for the writing wall charge forming pulse applying period, to turn ON the pMOS Ti3 and a control pulse is applied from the sustaining control circuit 40B to the gate of the nMOS Ti4, for the writing wall charge forming pulse applying period, to turn OFF the nMOS Ti4. As a result, a writing wall charge forming pulse 8 (see Cl in FIG. 11) is applied to the sustaining electrode Cl from specified time before ending time of the scanning pulse applying period. This is illustrated in FIG. 12B. FIG. 12A shows the state in the first embodiment.

Time during which the scanning pulse 6 and the writing wall charge forming pulse 8 overlap is set to be 0.2 μsec to 0.5 μsec (this is specified above). If the above two pulses overlap for a period of time of 0.5 μsec or more, during the overlapped time, a potential difference between the surface electrodes becomes "Vs+Vsw", erroneous discharge occurs between surface electrodes in some cases. When the overlapped time is made longer, the voltage "Vdsmin" decreases and the voltage drop stops in about 0.5 μsec. The voltage "Vdsmin" occurring when the scanning pulse 6 and writing wall charge forming pulse 8 overlap for 0.5 μsec is decreased more by 5 V to 7 V than the voltage "Vdsmin" obtained when no overlapping occurred. The writing wall charge forming pulse applying period during which a writing wall charge forming pulse is applied is the same as employed in the first embodiment.

Then, since the writing wall charge forming pulse 8 whose voltage is "Vs+Vsw" is applied to the sustaining electrode C1 during the writing wall charge forming pulse applying period, a potential difference between the scanning electrode S1 and sustaining electrode C1 becomes "Vs+Vsw−Vbw" at specified time before ending time of the scanning pulse applying period, a voltage being higher by a voltage "Vsw" than that employed in the conventional method is applied to the scanning electrode S1 and sustaining electrode C1.

As a result, even after termination of the application of the scanning pulse, movements of space charges between surface electrodes continue (see FIG. 3D) and, at time of termination of the application of the writing wall charge forming pulse 8, large amounts of positive wall charges are accumulated on the scanning electrode S1 and large amounts of negative wall charges on the sustaining electrode C1 (FIG. 3E), in the end.

Concrete set values for the writing wall charge forming pulse producing accumulation effects of wall charges are the same as those employed in the first embodiment. The effects produced by the writing wall charge forming pulse in that case are the same as those employed in the first embodiment shown in FIGS. 5 and 6. This indicates that, by applying a potential difference having a specified level or more to the scanning electrode and sustaining electrode at specified time before termination of the application of a scanning pulse, movements of charges continues and large amounts of wall charges are formed on the scanning electrode and the sustaining electrode.

In a state in which large amounts of positive wall charges are accumulated on the scanning electrode S1 and large amounts of negative wall charges on the sustaining electrode C1 at time of termination of the application of the writing wall charge forming pulse 8, operations start in the sustaining period 4. In the sustaining period 4, as in the conventional method, only when writing discharge occurred during the scanning period, large amounts of positive wall charges have been formed in the vicinity of the surface discharge gap on the scanning electrode S1 and large amounts of negative wall charges in the vicinity of the surface discharge gap on the sustaining electrode C1 and, therefore, sustaining discharge occurs and a display cell is put into a light-emitting state.

Thus, according to the driving method of the embodiment, by applying, from 0.2 μsec to 0.5 μsec before ending time of the scanning pulse applying period, a writing wall charge forming pulse to a sustaining electrode in the conventional driving method for the address-display separated-type AC PDP, the same effects as obtained in the first embodiment can be achieved.

FOURTH EMBODIMENT

Figure 13:
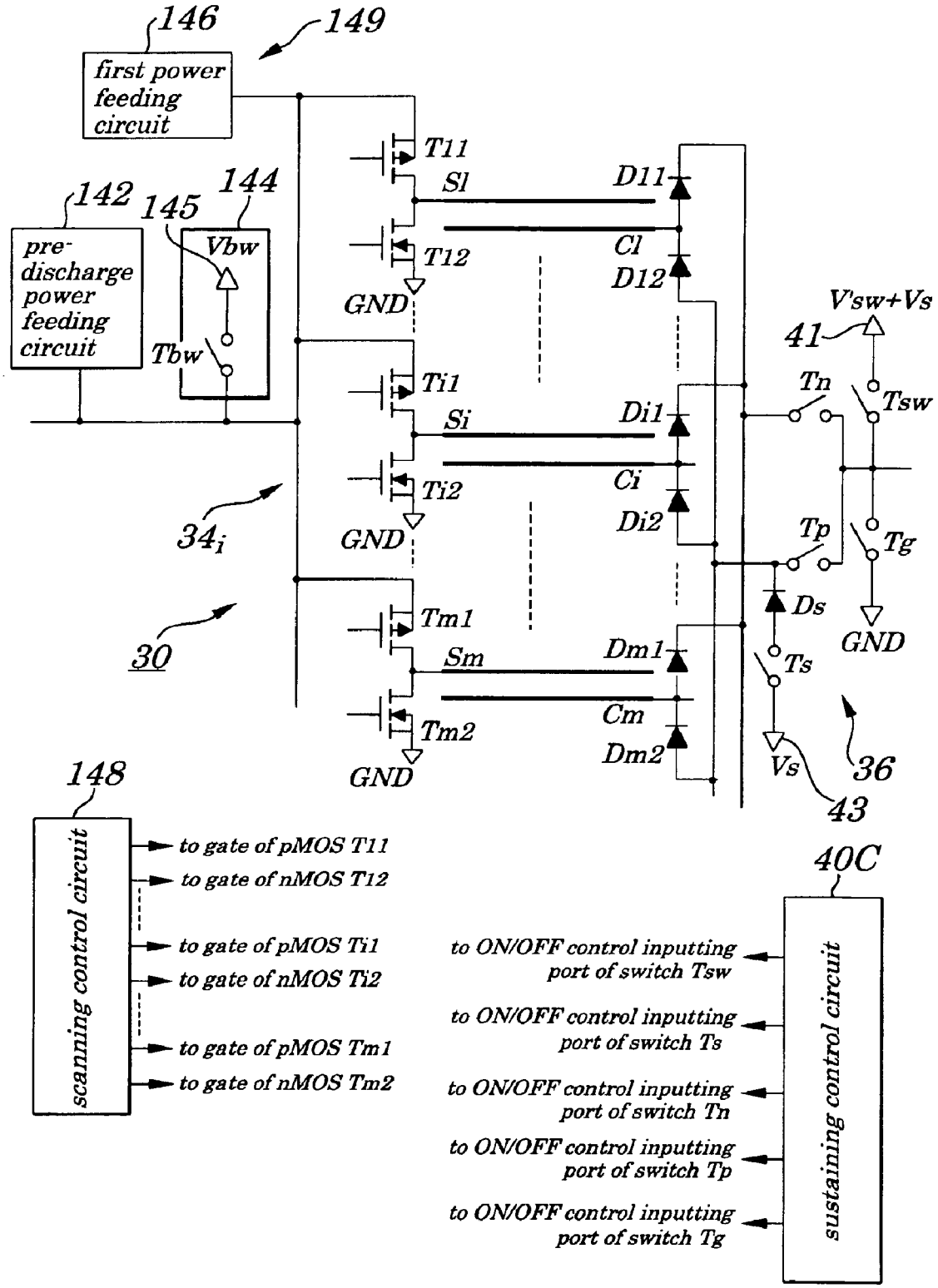
FIG. 13 is a diagram illustrating configurations of a driving device of an address-display separated-type AC PDP according to a fourth embodiment of the present invention.
Figure 14:
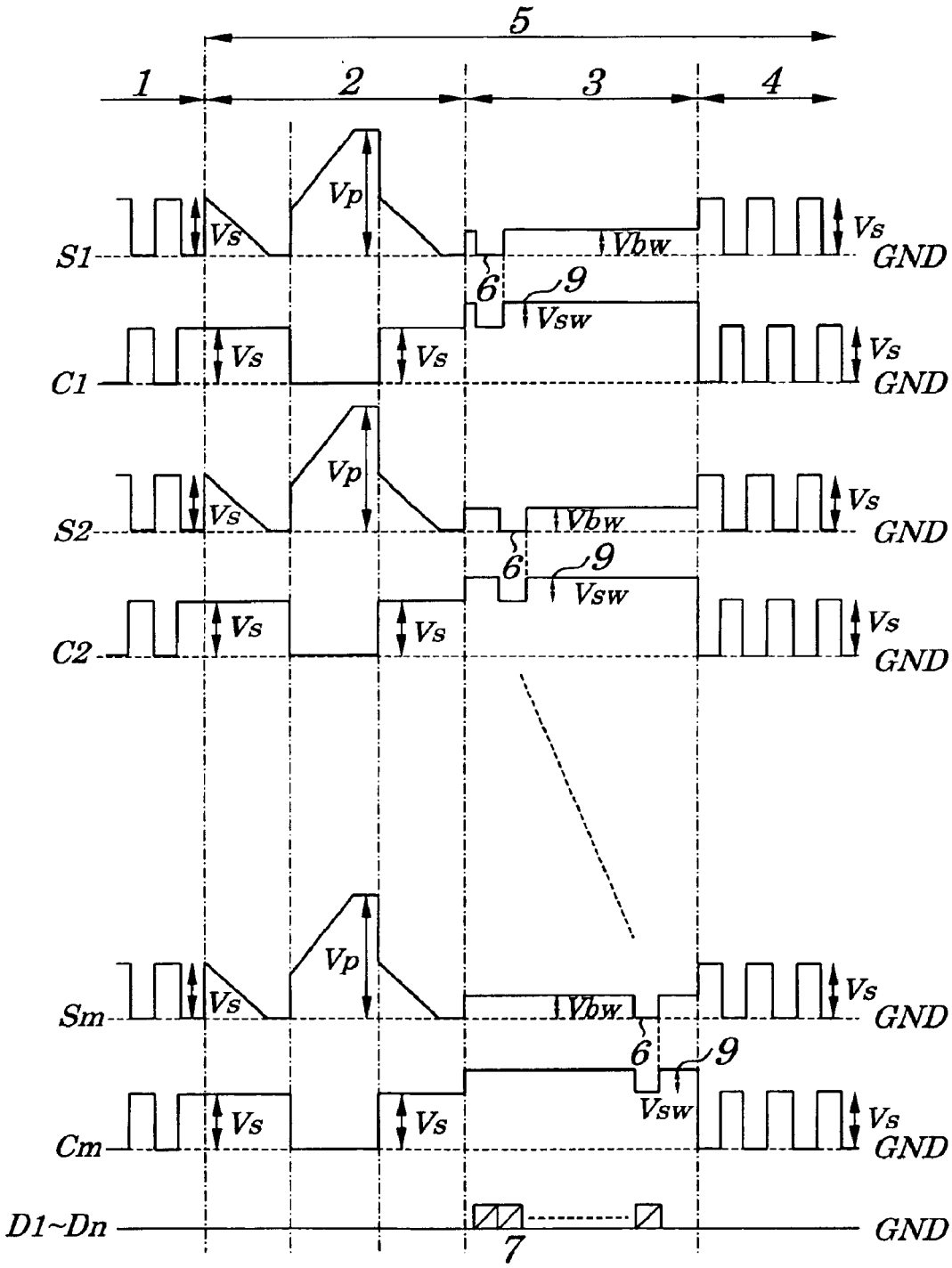
FIG. 14 is a diagram showing driving waveforms of pulses to drive the address-display separated-type AC PDP according to the fourth embodiment of the present invention.
Figure 15:
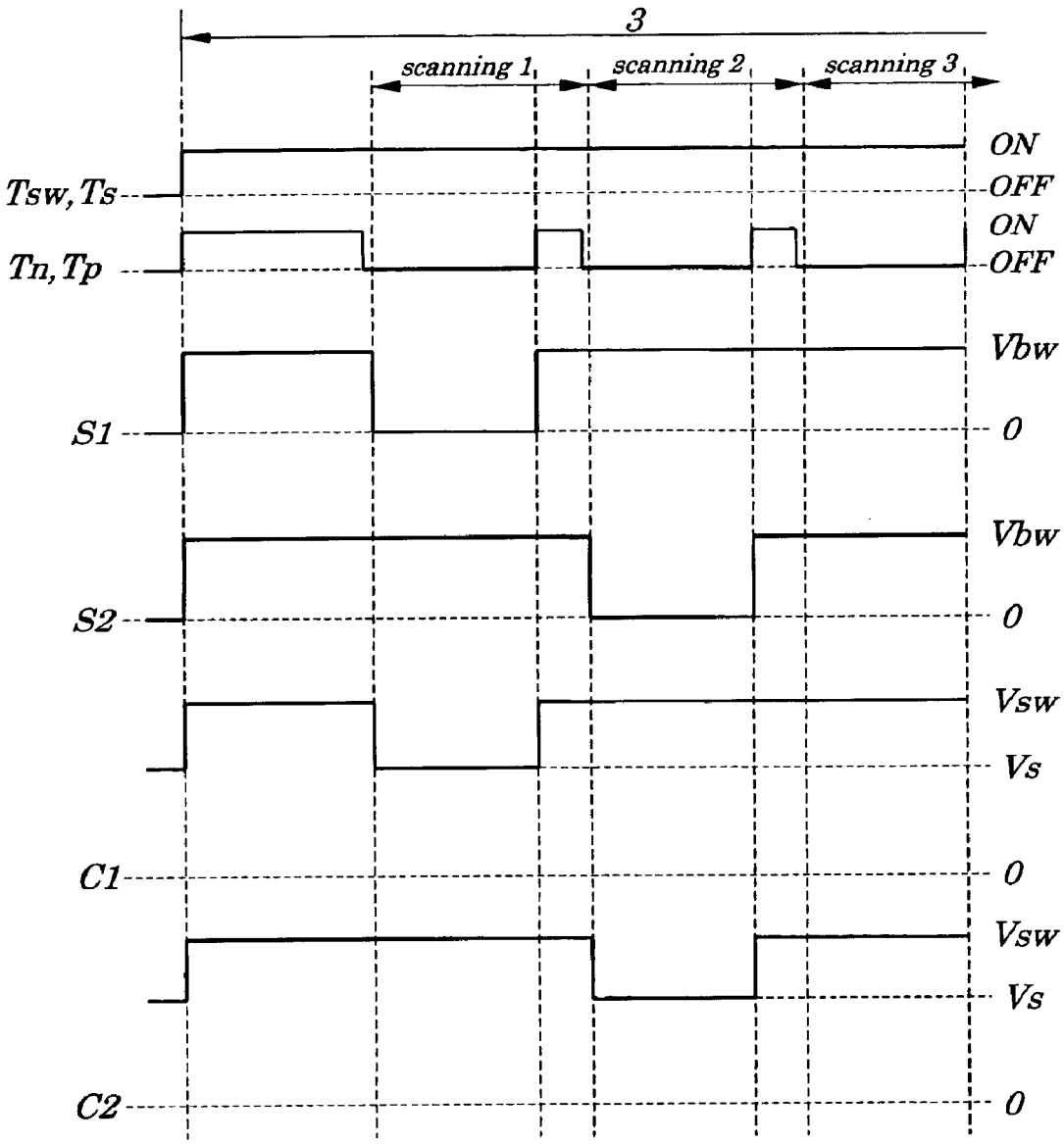
FIG. 15 is a partially expanded diagram showing the driving waveforms of the pulses shown in FIG. 14.

FIG. 13 is a diagram illustrating configurations of a driving device of an address-display separated-type AC PDP according to a fourth embodiment of the present invention. FIG. 14 is a diagram showing driving waveforms of pulses to drive the address-display separated-type AC PDP according to the fourth embodiment. FIG. 15 is a partially expanded diagram showing the driving waveforms of the pulses shown in FIG. 14. Operations employed in the fourth embodiment differ from those employed in the first embodiment in that a sustaining base voltage, instead of a writing wall charge forming pulse, is applied to a sustaining electrode.

A sustaining driver 36 shown in FIG. 13 is made up of a diode Di1 whose anode is connected to a sustaining electrode Ci, a switch Tn whose one terminal is connected to a cathode of the diode Di1, a switch Tsw whose one terminal is connected to another terminal of the switch Tn, a diode whose cathode is connected to the sustaining electrode Ci, a diode Ds whose cathode is connected to an anode of the diode Di2, a switch Ts whose one terminal is connected to an anode of the diode Ds, a switch Tp being connected between a connecting point between another terminal of the switch Tn and another terminal of the switch Tsw and a connecting point between an anode of a diode Di2 and a cathode of the diode Ds, a switch Tg being connected between a connecting point between another terminal of the switch Tn and one terminal of the switch Tsw and a ground potential port, and a sustaining control circuit 40C being connected to an ON/OFF control inputting port of each of the switch Tn, switch Tsw, switch Ts, switch Tg, and switch Tp and operating to exercise ON/OFF control on the switch Tn, Tsw, Ts, switch Tg and Tp. Another terminal of the switch Tsw is connected to a voltage source 41. A voltage that can be fed from the voltage source 41 is a sustaining voltage "Vsw'"+sustaining pulse voltage Vs". Another terminal of the switch Ts is connected to a voltage source 43. A voltage of the voltage source 43 is a sustaining pulse voltage Vs.

The sustaining base voltage "Vsw'" is a voltage which is lower than a writing wall charge forming pulse voltage "Vsw" and which can sufficiently form a wall charge even after termination of application of a scanning pulse and which does not cause occurrence of erroneous discharge even if the sustaining base voltage is applied during the scanning period 3. A period during which a voltage value "Vsw'" being the sustaining base voltage is applied to the sustaining electrode Ci is the scanning period 3 from which the scanning pulse applying period is excluded.

The sustaining control circuit 40C feeds, from a last half period (during which a positive pulse is applied) during which a last sustaining pulse is being applied in a specified period to the sustaining electrode S1 during a sustaining period 1 in a previous sub-field to ending time of a period during which a first sawtooth wave signal is applied to the scanning electrode S1, a control pulse to turn ON the switch Ts to the switch Ts and also a control pulse to turn OFF the switches Tn, Tp, Tsw, and Tg to an ON/OFF control inputting port of each of the switches Tn, Tp, Tsw, and Tg. The sustaining control circuit 40C also feeds, from ending time of a period during which a first sawtooth wave signal is applied to the scanning electrode Si to ending time of a period during which a second sawtooth wave signal is applied to the scanning electrode Si, a control pulse to turn OFF the switch Tn, Ts, and Tsw to the ON/OFF control inputting port of each of the switches Tn, Ts, and Tsw and also a control pulse to turn ON the switch Tp and Tg to the ON/OFF control inputting port of each of the switches Tp and Tg.

Also, the sustaining control circuit 40C feeds, until ending time of a period during which a second sawtooth wave signal is applied to the sustaining electrode Ci, that is, until ending time of the scanning period 3 from starting time of a period during which a last sawtooth wave signal is applied to the sustaining electrode Ci, a control pulse to turn ON the switch Ts to the ON/OFF control inputting port of the switch Ts and also a control pulse to turn ON the switch Tsw to the ON/OFF control inputting port of the Tsw during the scanning period 3. On the other hand, the sustaining control circuit 40C feeds, at starting time of the scanning period 3, a control pulse to turn ON the switches Tn and Tp to the ON/OFF control inputting port of each of the switches Tn and Tp and also feeds, immediately before a scanning pulse is applied to any one of scanning electrodes, a control pulse to turn OFF the switches Tn and Tp to the ON/OFF control inputting port of each of the switches Tn and Tp and, at time of termination of the application of a scanning pulse, a control pulse to turn ON the switches Tn and Tp to the ON/OFF control inputting port of each of the switches Tn and Tp.

Also, the sustaining control circuit 40C feeds, for a period from ending time of the scanning period 3 through the sustaining period 4, a control pulse to turn OFF the switches Tn and Tsw to the ON/OFF control inputting port and, during the sustaining period 4, a control pulse to turn ON the switch Tp to the ON/OFF control inputting port of the switch Tp and, from starting time of the sustaining period 4 and for a first half of a period during which a sustaining pulse is being applied, a control pulse to turn ON the switch Tg and a control pulse to turn OFF the switch Ts and for a second half of a period during which the sustaining pulse is being applied, a control pulse to turn OFF the switch Tg and a control pulse to turn ON the switch Ts to the ON/OFF control inputting port of the switch Tg and the ON/OFF control inputting port of the switch Ts alternately for every half of the period during which the sustaining pulse is being applied. Configurations of each component of the fourth embodiment are the same as those in the first embodiment except the difference described above and same reference numbers are assigned to components having the same function as those in the first embodiment and their descriptions are omitted accordingly.

Next, operations of the driving device of the embodiment are described by referring to FIG. 13 to 15. Operations to be performed before a scanning pulse applying period starts are the same as those in the first embodiment. When a scanning period 3 during which an operation for a first scanning line of a video signal starts, the sustaining control circuit 40C feeds, during the scanning period 3, a control pulse to turn ON the switch Tsw to the switch Tsw (see Tsw in FIGS. 14 and 15). Moreover, the switch Ts, as in the case of the first embodiment, is turned ON at starting time of the application of a last sawtooth wave signal and the ON state continues till ending time of the scanning period 3. Also, the sustaining control circuit 40C, when the scanning period 3 starts, feeds a control pulse to turn ON the switches Tn and Tp to the switches Tn and Tp. As a result, a potential of "Vsw'+Vs" is applied to all the sustaining electrode Ci.

In this state, let it be assumed that an operation for the first scanning line of a video signal is started. Immediately before the scanning pulse 6 is applied, as in the conventional method, to the scanning electrode Sl corresponding to the scanning line, the sustaining control circuit 40C feeds a control pulse to turn OFF the switches Tn and Tp to the switches Tn and Tp (see Tn and Tp in FIG. 15). Since the cathode of the diode Ds is of a positive potential relative to the anode, the diode Ds is brought out of conduction and the sustaining electrode Ci is substantially put into a state of floating.

Immediately after that, when a scanning pulse is applied to the scanning electrode S1 (see S1 in FIG. 15), though only a potential of the sustaining electrode C1 being paired with the scanning electrode S1 is lowered due to capacitive coupling, the sustaining electrode C1 is connected to the voltage source 43 through the diode Ds and, therefore, the potential of the sustaining electrode C1 does not become lower than a voltage Vs. As in the first embodiment, a scanning pulse is applied to the scanning electrode S1 and in a state that the potential of the sustaining electrode C1 is lowered to be "Vs", a data pulse corresponding to a pixel is sequentially applied to data electrodes D1 to Dn and writing discharge corresponding to a data pulse occurs in each of display cells $\mathbf{131}_{11}$ to $\mathbf{131}_{1n}$.

Then, at termination time of the application of the above scanning pulse 6, the sustaining control circuit 40C feeds a control pulse to turn ON the switches Tn and Tp to the switches Tn and Tp (see Tn and Tp in FIG. 15). When the switches Tn and Tp are turned ON, potentials of all sustaining electrodes Ci become "Vsw'+Vs". As a result, a potential of the sustaining electrode C1 is changed from "Vs" to "Vsw'+Vs" and a sustaining base voltage 9 (C1 in FIG. 14) is applied to the sustaining electrode C1.

As in the case of the first embodiment, by the application of the sustaining base voltage 9 to the sustaining electrode C1, sufficient positive wall charges are accumulated on the scanning electrode corresponding to every display cell in which the above writing discharge has occurred, out of the display cells $\mathbf{131}_{11}$ to $\mathbf{131}_{1n}$, and sufficient negative wall charges are accumulated on the sustaining electrode of the display cell.

In the similar manner, an operation for the second scanning line starts and immediately before the scanning pulse 6 is applied to the scanning electrode S2, the sustaining control circuit 40C feeds a control pulse to turn OFF the switches Tn and Tp to the switches Tn and Tp (see Tn and Tp in FIG. 15). At this time point, the sustaining electrode C2 is put into a floating state. Immediately after that, when a scanning pulse is applied to the scanning electrode S2 (S2 in FIG. 15), only a potential of the sustaining electrode C2 being paired with the scanning electrode S2 is lowered due to capacitive coupling, however, according to the same principle as worked for the first scanning line, the potential of the sustaining electrode C2 does not become lower than "Vs".

As in the first embodiment, a scanning pulse is applied to the scanning electrode S2 and in a state that the potential of the sustaining electrode C2 is lowered to be "Vs", a data pulse corresponding to a pixel is sequentially applied to data electrodes D1 to Dn and writing discharge corresponding to a data pulse occurs in each of display cells $\mathbf{131}_{21}$ to $\mathbf{131}_{2n}$.

Then, at time of termination of the application of the scanning pulse 6 that was applied to the scanning electrode S2, the sustaining control circuit 40C feeds a control pulse to turn ON the switches Tn and Tp to the switches Tn and Tp (see Tn and Tp in FIG. 15). When the switches Tn and Tp are turned ON, potentials of all sustaining electrodes Ci become "Vsw'+Vs". As a result, a potential of the sustaining electrode C2 is changed from "Vs" to "Vsw'+Vs" and a sustaining base voltage 9 (C2 in FIG. 14) is applied to the sustaining electrode C2.

As in the case of the first embodiment, by the application of the sustaining base voltage 9 to the sustaining electrode C2, sufficient positive wall charges are accumulated on the scanning electrode corresponding to every display cell in which the above writing discharge has occurred, out of the display cells $\mathbf{131}_{21}$ to $\mathbf{131}_{2n}$, and sufficient negative wall charges are accumulated on the sustaining electrode of the display cell.

Hereinafter, same operations as above are repeated for every scanning line. In any one of the operations, before the scanning pulse 6 is applied to the scanning electrode corresponding to the scanning line, when each of the sustaining electrodes is put into a floating state and the scanning pulse 6 is applied to the scanning electrode corresponding to the scanning line, a potential of the scanning electrode being paired with the scanning electrode corresponding to the scanning line is lowered to be "Vs".

Furthermore, as in the case of the first embodiment in the operations repeated as above, a scanning pulse is applied to the scanning electrode and a potential of the sustaining electrode corresponding to the scanning electrode is lowered to be "Vs". In this state, a data pulse corresponding to a pixel is fed sequentially to data electrodes D1 to Dn and writing discharge corresponding to the data pulse occurs in each of display cells $\mathbf{131}_{il}$ to $\mathbf{132}_{in}$ (here, "i", denotes a scanning line on which an operation is performed). Then, at termination time of the application of the scanning pulse 6, the potential of the sustaining electrode corresponding to the above scanning electrode again becomes "Vsw'+Vs" and, by the application of the sustaining base voltage 9 to the sustaining electrode, sufficient positive wall charges are accumulated on the scanning electrode for every display cell, out of the display cells $\mathbf{131}_{il}$ to $\mathbf{131}_{in}$, in which the above writing discharge occurs and sufficient negative wall charges are accumulated on the sustaining electrode for the display cell.

As described above, in the fourth embodiment, unlike in the case of the above first to third embodiments, the sustaining base voltage 9 to be applied to any sustaining electrodes Ci has been fed to the sustaining electrode also before the application of the scanning pulse. In the fourth embodiment, the sustaining base voltage 9 (Vsw') is set to be 20 V to 100 V. When the sustaining base voltage 9 is set to be 120 V, erroneous discharge occurred. Even if the sustaining base voltage 9 is applied before the application of the scanning pulse 6, an increase in the voltage value "Vdsmin" of the sustaining pulse voltage. "Vs" at which normal operations can be performed could not be suppressed. However, when the sustaining base voltage 9 is fed after the application of the scanning pulse 6 and the sustaining base voltage 9 is set to be high, as in the case of the first to third embodiments, there was a tendency that the sustaining pulse voltage "Vdsmin" at which normal operations can be performed and the voltage "Vdmin" of the data pulse at which normal operations can be performed were decreased.

That is, it can be thought that, in the scanning period other than a period during which a scanning pulse is not applied, when a potential which has a voltage exceeding a specified voltage level and at which no erroneous discharge occurs is applied between the scanning electrode and sustaining electrode, movements of charges continue ever after the application of a scanning pulse and large amounts of wall charges are formed on the scanning electrode and sustaining electrode.

Thus, according to the driving method of the fourth embodiment, in the conventional driving method for the address-display separated-type AC plasma display panel, also by applying a sustaining base voltage to a sustaining electrode to which a scanning pulse is being applied, the same effects as obtained in the first embodiment can be achieved. Moreover, in the first embodiment, the sustaining driver corresponding to the number of the sustaining electrodes is required, however, in the fourth embodiment, since the switches Tsw, Tn, and Tp can be used commonly for each of the sustaining electrodes, it is made possible to simplify configurations of the sustaining driver and to reduce related costs.

FIFTH EMBODIMENT

Figure 16:
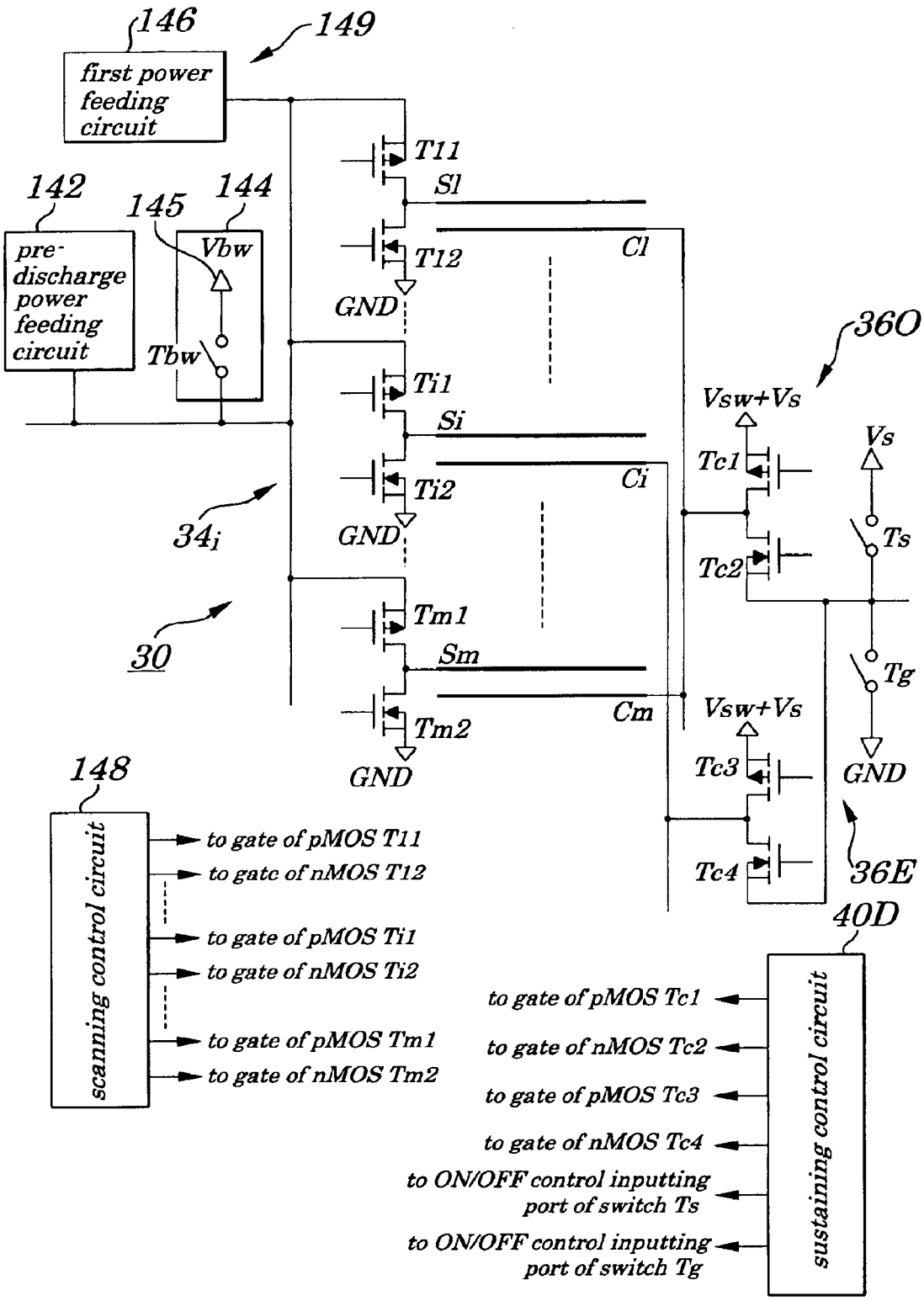
FIG. 16 is a diagram illustrating configurations of a driving device of an address-display separated-type AC PDP according to a fifth embodiment of the present invention.
Figure 17:
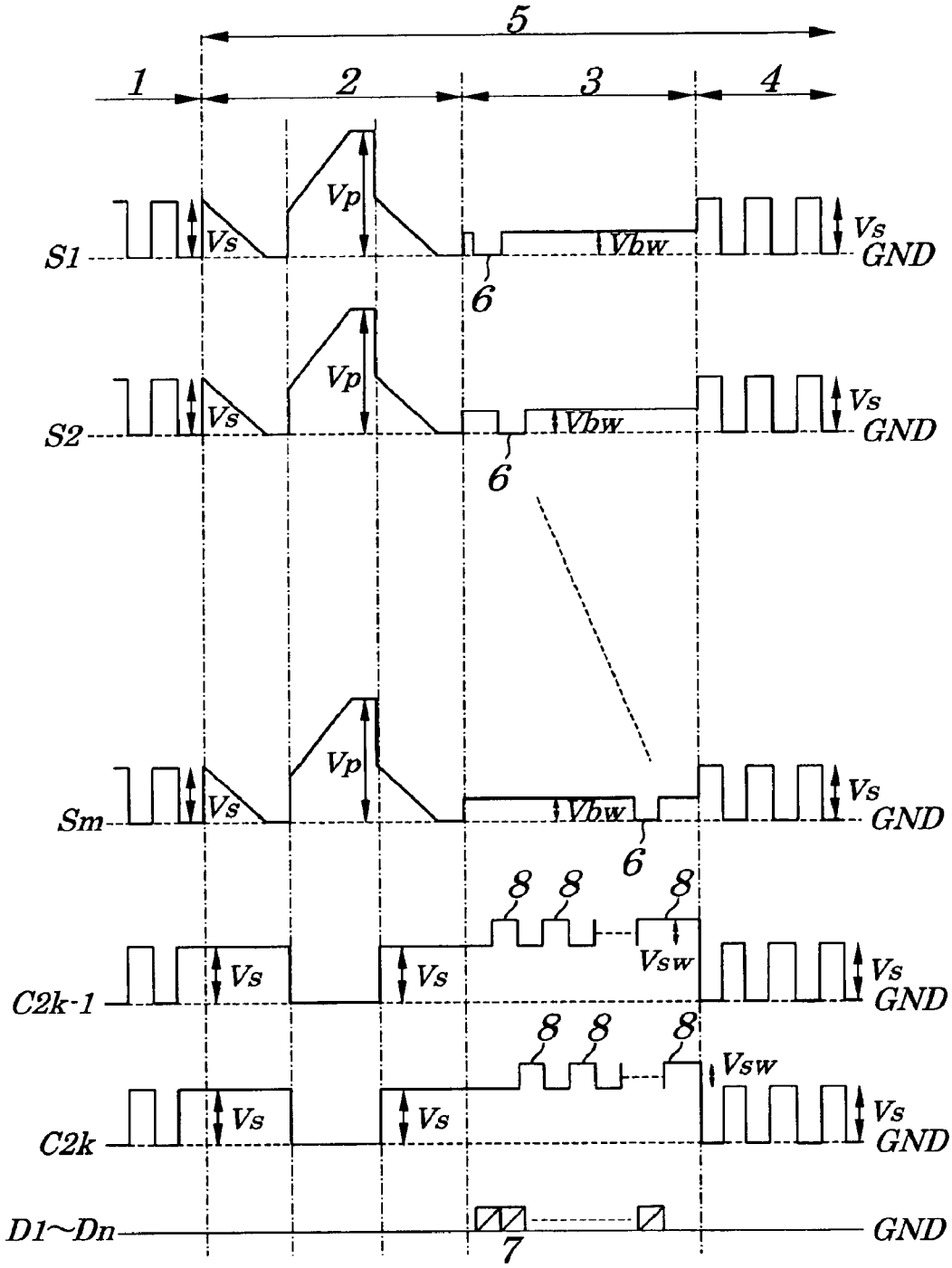
FIG. 17 is a diagram showing driving waveforms of pulses to drive the address-display separated-type AC PDP according to the fifth embodiment of the present invention.

FIG. 16 is a diagram illustrating configurations of a driving device of an address-display separated-type AC PDP according to a fifth embodiment of the present invention. FIG. 17 is a diagram showing driving waveforms of pulses to drive the address-display separated-type AC PDP according to the fifth embodiment of the present invention. Configurations of the driving device of the fifth embodiment differ from those of the first embodiment in that, for application of a writing wall charge forming pulse to a sustaining electrode, one sustaining driver is connected to all odd-numbered sustaining electrodes and another sustaining drive to all even-numbered sustaining electrodes.

That is, a sustaining driver 36O drives the odd-numbered sustaining electrodes $C_{2K-1}$(k is one of 1, 2, . . . , m) and a sustaining driver 36E drives the even-numbered sustaining electrodes $C_{2k}$. The sustaining driver 360 has a pMOS Tc1 and an nMOS Tc2 and the sustaining driver 36E has a pMOS Tc3 and an nMOS Tc4. Switches Ts and Tg are used commonly for the sustaining driver 36O and the sustaining driver 36E, which exercise ON/OFF control on the pMOS Tc1 and nMOS Tc2 for the sustaining driver 36O and on the pMOS T3 and the nMOS T4 for the sustaining driver 36E. A sustaining control circuit 40D exercises ON/OFF control on the switches Ts and Tg.

The sustaining control circuit 40D feeds, from a last half of a period during which a last sustaining pulse is applied to the odd-numbered and even-numbered sustaining electrodes in a sustaining period in a previous sub-field to time at which a scanning pulse is applied to the odd-numbered and even-numbered scanning electrodes, a control pulse to turn ON the nMOS Tc2 and nMOS Tc4 to the nMOS Tc2 and nMOS Tc4. The sustaining control circuit 40D also feeds, from a last half of a period during which a last sustaining pulse is applied to the odd-numbered and even-numbered sustaining electrodes in a sustaining period in a previous sub-field to ending time of a period during which a first sawtooth-like wave signal is applied to the odd-numbered and even-numbered scanning electrodes, a control pulse to turn ON the switch Ts to an ON/OFF control inputting port of the switch Ts and a control pulse to turn ON the switch Tg to an ON/OFF control inputting port of the switch Tg and, from a last half of a period during which the above last sustaining pulse is applied to time at which a scanning pulse is applied to the odd-numbered and even-numbered scanning electrodes, a control pulse to turn ON the pMOS Tc1 and pMOS Tc3 to a gate of each of the pMOS Tc1 and the pMOS Tc3.

Also, the sustaining control circuit 40D feeds, from ending time of a period during which a first sawtooth-like wave signal is applied to the odd-numbered and even-numbered scanning electrodes to ending time a period during which a second sawtooth-wave signal is applied, a control pulse to turn OFF the switch Ts to an ON/OFF control inputting port of the switch Ts and a control pulse to turn ON the switch Tg to an ON/OFF control inputting port of the switch Tg.

Also, the sustaining control circuit 40D feeds, from ending time of a period during which the second sawtooth-like wave signal to ending time of the scanning period 3, a control pulse to turn ON the switch Ts to the ON/OFF control inputting port of the switch Ts and a control pulse to turn OFF the switch Tg to the ON/OFF control inputting port of the switch Tg.

Also, the sustaining control circuit 40D feeds, in a period during which odd-numbered sustaining electrodes $C_{2k-1}$ in the scanning period are driven, a control pulse to turn OFF the pMOS Tc3 of the sustaining driver 36E to a gate of the pMOS Tc3 and a control pulse to turn OFF the nMOS Tc4 to a gate of the nMOS Tc4.

Also, the sustaining control circuit 40D feeds, every time when a writing wall charge forming pulse is applied to the odd-numbered sustaining electrode $C_{2k-1}$ whenever the application of a scanning pulse to the odd-numbered scanning electrode ends, a control pulse to turn ON the pMOS Tc1 of the sustaining driver 36O to a gate of the pMOS Tc1 and a control pulse to turn OFF the nMOS Tc2 to a gate of the nMOS Tc2.

Also, the sustaining control circuit 40D feeds, from ending time of a period during which a last writing wall charge forming pulse is applied to the odd-numbered sustaining electrode $C_{2k-1}$ to ending time of the scanning period, a control pulse to turn OFF the pMOS Tc1 of the sustaining driver 36O to the gate of the pMOS Tc1 and a control pulse to turn ON the nMOS Tc2 to the gate of the nMOS Tc2.

Also, the sustaining control circuit 40D feeds, for a period during which the even-numbered sustaining electrode $C_{2k}$ in the scanning period is driven, a control pulse to turn OFF the pMOS Tc1 of the sustaining driver 36O to the gate of the pMOS Tc1 and a control pulse to turn OFF the nMOS Tc2 to the gate of the nMOS Tc2.

Also, the sustaining control circuit 40D feeds, every time when a writing wall charge forming pulse is applied to the even-numbered sustaining electrode $C_{2k}$ whenever the application of a scanning pulse to the even-numbered scanning electrode ends, a control pulse to turn ON the pMOS Tc3 of the sustaining driver 36E to the gate of the pMOS Tc3 and a control pulse to turn OFF the nMOS Tc4 to the gate of the nMOS Tc4.

Also, the sustaining control circuit 40D feeds, from ending time of a period during which a last writing wall charge forming pulse is applied to the even-numbered sustaining electrodes $C_{2k}$ to ending time of the scanning period, a control pulse to turn OFF the pMOS Tc3 of the sustaining driver 36E to the gate of the pMOS Tc3 and a control pulse to turn ON the nMOS Tc4 to the gate of the nMOS Tc4.

Moreover, the sustaining control circuit 40D repeats operations, alternately in every half of a period during which a sustaining pulse is applied, that it feeds, for a first half of the period during which a sustaining pulse (negative pulse) is applied to a sustaining electrode in a certain period in a sustaining period, a control pulse to turn OFF the switch Ts to the ON/OFF control inputting port of the switch Ts and a control pulse to turn ON the switch Tg to the ON/OFF control inputting port of the switch Tg and that it feeds, for a last half of the period during which a sustaining pulse (positive pulse) is applied, a control pulse to turn ON the switch Ts to the ON/OFF control inputting port of the switch Ts and a control pulse to turn OFF the switch Tg to the ON/OFF control inputting port of the switch Tg. Configurations of each component of the fifth embodiment are the same as those in the first embodiment except the difference described above and same reference numbers are assigned to components having the same function as those in the first embodiment and their descriptions are omitted accordingly.

Next, operations of the driving method employed in the fifth embodiment are described by referring to FIGS. 16 and 17. Operations performed until a period during which a scanning pulse is applied to any scanning electrode ends in the fifth embodiment are the same as in the first embodiment. Operations of any scanning electrode performed during the scanning period 3 are the same except following points.

That is, the sustaining control circuit 40D, from ending time of a period during which a scanning pulse is applied to the odd-numbered scanning electrodes $C_{2k-1}$ and for a period during which a writing wall charge forming pulse is applied, feeds a control pulse to the gate of the pMOS Tc1 to turn ON the pMOS Tc1 and a control pulse to the gate of the nMOS Tc2 to turn OFF the nMOS Tc2. Also, the sustaining control circuit 40D, as in the case of the first embodiment, from time at which application of a last sawtooth-wave signal starts to ending time of the scanning period 3, feeds a control pulse to turn ON the switch Ts to the switch Ts.

Then, the sustaining control circuit 40D, at time of termination of a period during which the writing wall charge forming pulse is applied, feeds a control pulse to the gate of the pMOS Tc1 to turn OFF the pMOS Tc1 of the sustaining driver 360 and another control pulse to the gate of the nMOS Tc2 to turn ON the nMOS Tc2.

Similarly, the sustaining control circuit 40D, from ending time of a period during which a scanning pulse is applied to the even-numbered scanning electrodes $C_{2k-1}$ and for a period during which a writing wall charge forming pulse is applied, feeds a control pulse to the gate of the pMOS Tc3 to turn ON the pMOS Tc3 of the sustaining driver 36E and a control pulse to the gate of the nMOS Tc4 to turn OFF the nMOS Tc4.

Then, the sustaining control circuit 40D, at ending time of a period during which the writing wall charge forming pulse is applied, feeds a control pulse to the gate of the pMOS Tc3 to turn OFF the pMOS Tc3 of the sustaining driver 36E and another control pulse to the gate of the nMOS Tc4 to turn ON the nMOS Tc4.

Therefore, from ending time of a period during which a scanning pulse is applied to the sustaining electrode corresponding to the scanning line for a video signal, a writing wall charge forming pulse is applied to the sustaining electrode (hereafter called a sustaining electrode being scanned) being paired with the scanning electrode to which a scanning pulse has been applied (hereafter called a scanning electrode being scanned). When a data pulse was applied to the data electrode corresponding to the above scanning electrode being scanned prior to the application of the writing wall charge forming pulse to the sustaining electrode being scanned and if writing charge occurred then in the display cell, as in the case of the first embodiment, even after the time of termination of the application of the scanning pulse, movements of space charges between surface electrodes continue in the display cell (see FIG. 3D), at time of termination of the application of the writing wall charge forming pulse 8, large amounts of positive wall charges are accumulated on the scanning electrode being scanned and large amounts of negative wall charges on the sustaining electrode being scanned, in the end.

As a result, operations can be started in the sustaining period 4 in a state in which, at time of termination time of application of the writing wall charge forming pulse 8, large amounts of positive wall charges are accumulated on the scanning electrode being scanned and large amounts of negative wall charges are accumulated on the sustaining electrode being scanned and, therefore, in the sustaining period 4, as in the conventional case, discharge occurs and the display cell is put into a lit state. By operating as above, control on lighting and non-lighting of the display cell can be exercised.

Thus, according to the driving method of the fourth embodiment, in the conventional driving method for the address-display separated-type AC plasma display panel, by driving an odd-numbered sustaining electrode using the sustaining driver being commonly used in each of the odd-numbered sustaining electrodes and by driving an even-numbered sustaining electrode using the sustaining driver being commonly used in each of the even-numbered sustaining electrodes, the same effects as obtained in the first embodiment can be achieved. Also, in the first embodiment, the sustaining drivers corresponding to the number of sustaining electrodes are required, however, in the fifth embodiment, the sustaining driver being commonly used in the odd-numbered sustaining electrodes and the sustaining driver being commonly used in the even-numbered sustaining electrodes may be mounted and, therefore, the sustaining driver can be greatly simplified and costs of the sustaining driver can be reduced.

It is apparent that the present invention is not limited to the above embodiments but may be changed and modified without departing from the scope and spirit of the invention. For example, the surface firing voltage varies depending on dimensions of an electrode, interval of an electrode, discharge gas, dielectric layer, or a like and, therefore, a value other than those shown in the above embodiments may be used. Similarly, a width of a writing wall charge forming pulse, relation of application time between the scanning pulse and writing wall charge forming pulse, overlapping of the scanning pulse and writing wall charge forming pulse while being applied, sustaining base voltage also vary depending on conditions such as a kind of gas, gas pressure and, therefore, a value other than those described in the embodiments may be employed. Any switch, so long as it is of an electronic type, may be used. In the first, second, third and fifth embodiments, an amplitude of the writing wall charge forming pulse and of the sustaining pulse are set to be the same, however, if common use of the power source is not considered, the amplitudes may be different from each other. Moreover, in order to facilitate of formation of wall charges, the amplitude of the sustaining pulse is preferably made large.

What is claimed is:

1. A method for driving an address-display separated-type AC (Alternating Current) plasma display panel in which a first insulating substrate and a second insulating substrate are mounted at a specified interval in a manner to oppose to each other, a first specified number of pairs of a scanning electrode and a sustaining electrode being positioned in parallel to each other is arranged on a face of said first insulating substrate, said face being opposite to said second insulating substrate, and a second specified number of data electrodes being positioned in orthogonal to each of said pairs of said scanning electrode and said sustaining electrode is arranged on a face of said second insulating substrate, said face being opposite to said first insulating substrate, wherein pixel data corresponding to a video signal is sequentially written in a scanning period in each of display cells formed at an intersecting point between each of said pairs of said scanning electrode and sustaining electrode and each of said data electrodes and displaying of written pixels is sustained by sustaining discharge in a sustaining period, said method comprising:

a step of applying a scanning pulse to each of said scanning electrodes in said scanning period with different timing; and a step of feeding across said scanning electrode and said sustaining electrode making up said pairs, for a first specified period of time from first specified time after termination of a period during which said scanning pulse is applied, a potential difference being two-thirds or more of a surface firing voltage at which surface discharge occurs between said scanning electrode and said sustaining electrode making up said pairs and being the potential difference at which no discharge is started between said scanning electrode and said sustaining electrode making up said pairs, between said scanning electrode and said sustaining electrode making up said pairs.

2. The method for driving an address-display separated-type AC plasma display panel according to claim 1, wherein said first specified time is arbitrary time existing between time of termination of a period during which said scanning pulse is applied and time at which formation of wall charges required for said sustaining discharge is unable to occur and said first period of time is a period of time that can be arbitrarily selected during a period of time existing from said first specified time to time at which, though formation of wall charges is made to continue by movements of space charges between said scanning electrode and said sustaining electrode making up said pairs, no erroneous discharge occurs.

3. The method for driving an address-display separated-type AC plasma display panel according to claim 1, wherein, by applying a writing wall charge forming pulse, having a polarity reverse to that of said scanning pulse, to said sustaining electrode being paired with said scanning electrode to which said scanning pulse is applied during said period of time from said arbitrary time, said potential difference is generated between said scanning electrode and said sustaining electrode making up said pairs.

4. The method for driving an address-display separated-type AC plasma display panel according to claim 1, wherein, by dividing said two or more sustaining electrodes into two sustaining electrode groups and by sequentially and alternately applying said scanning pulse to said scanning electrode selected from scanning electrodes being paired with said sustaining electrode making up each of said two sustaining electrode groups and by alternately applying a writing wall charge forming pulse, having a polarity reverse to that of said scanning pulse, to each of said sustaining electrodes in said group to which said sustaining electrode being paired with said scanning electrode to which said scanning pulse is applied belongs from time of termination of a period during which said scanning pulse is applied to a period of said first specified period of time in a period of application of said scanning pulse in every group, said potential difference is made to be generated between said scanning electrode and said sustaining electrode making up said pairs.

5. The method for driving an address-display separated-type AC plasma display panel according to claim 1, wherein a potential of said scanning pulse is lower by a specified value than a potential of said scanning pulse being applied in said scanning period other than a period during which said scanning pulse is applied.

6. A method for driving an address-display separated-type AC (Alternating Current) plasma display panel in which a first insulating substrate and a second insulating substrate are mounted at a specified interval in a manner to oppose to each other, a first specified number of pairs of a scanning electrode and a sustaining electrode being positioned in parallel to each other is arranged on a face of said first insulating substrate, said face being opposite to said second insulating substrate, and a second specified number of data electrodes being positioned in orthogonal to each of said pairs of said scanning electrode and said sustaining electrode is arranged on a face of said second insulating substrate, said face being opposite to said first insulating substrate, wherein pixel data corresponding to a video signal is sequentially written in a scanning period in each of display cells formed at an intersecting point between each of said pairs of said scanning electrode and sustaining electrode and each of said data electrodes and displaying of written pixels is sustained by sustaining discharge in a sustaining period, said method comprising:

a step of applying a scanning pulse to each of said scanning electrodes in said scanning period with different timing; and a step of feeding across said scanning electrode and said sustaining electrode making up said pairs, for a second specified period of time from second specified time before termination of a period during which said scanning pulse is applied, a potential difference being two-thirds or more of a surface firing voltage at which surface discharge occurs between said scanning electrode and said sustaining electrode making up said pairs and being the potential difference at which no discharge occurs between said scanning electrode and said sustaining electrode making up said pairs between said scanning electrode and said sustaining electrode making up said pairs.

7. The method for driving an address-display separated-type AC plasma display panel according to claim 6, wherein said second specified time is arbitrary time existing between time after time of termination of a period during which no erroneous discharge occurs when said potential difference is applied between said scanning electrode and said sustaining electrode making up said pairs and time of termination of a period during which said scanning pulse is applied and wherein said second period of time is a period of time that can be arbitrarily selected during a period of time existing from said second specified time to time at which, though formation of wall charges is made to continue by movements of space charges between said scanning electrode and said sustaining electrode making up said pair, no erroneous discharge occurs.

8. The method for driving an address-display separated-type AC plasma display panel according to claim 6, wherein, by applying a writing wall charge forming pulse, having a polarity reverse to that of said scanning pulse, to said sustaining electrode being paired with said scanning electrode to which said scanning pulse is applied during said period of time from said arbitrary time, said potential difference is generated between said scanning electrode and sustaining electrode making up said pairs.

9. The method for driving an address-display separated-type AC plasma display panel according to claim 6, wherein a potential of said scanning pulse is lower by a specified value than a potential of said scanning pulse being applied in said scanning period other than a period during which said scanning pulse is applied.

10. A method for driving an address-display separated-type AC (Alternating Current) plasma display panel in which a first insulating substrate and a second insulating substrate are mounted at a specified interval in a manner to oppose to each other, a first specified number of pairs of a scanning electrode and a sustaining electrode being positioned in parallel to each other is arranged on a face of said first insulating substrate, said face being opposite to said second insulating substrate, and a second specified number of data electrodes being positioned in orthogonal to each of said pairs of said scanning electrode and said sustaining electrode is arranged on a face of said second insulating substrate, said face being opposite to said first insulating substrate, wherein pixel data corresponding to a video signal is sequentially written in a scanning period in each of display cells formed at an intersecting point between each of said pairs of said scanning electrode and sustaining electrode and each of said data electrodes and displaying of written pixels is sustained by sustaining discharge in a sustaining period, said method comprising:

a step of applying a scanning pulse to each of said scanning electrodes during said scanning period with different timing; and a step of feeding across said scanning electrode and said sustaining electrode making up said pairs, in said scanning period during which said scanning pulse is not applied, a potential difference being two-thirds or more of a surface firing voltage at which surface discharge occurs between said scanning electrode and said sustaining electrode making up said pairs and being the potential difference at which no discharge occurs between said scanning electrode and said sustaining electrode making up said pairs.

11. The method for driving an address-display separated-type AC plasma display panel according to claim 10, wherein, by applying a sustaining base voltage, having a polarity reverse to that of said scanning pulse, in said scanning period during which said scanning pulse is not applied to said sustaining electrode being paired with said scanning electrode to which said scanning pulse is applied, said potential difference is produced between said scanning electrode and said sustaining electrode making up said pairs.

12. The method for driving an address-display separated-type AC plasma display panel according to claim 10, wherein a potential of said scanning pulse is lower by a specified value than a potential of said scanning pulse being applied in said scanning period other than a period during which said scanning pulse is applied.

13. A driving device for an address-display separated-type AC plasma display panel comprising:

a plasma display panel in which a first insulating substrate and a second insulating substrate are mounted at a specified interval in a manner to oppose to each other, a first specified number of pairs of a scanning electrode and a sustaining electrode being positioned in parallel to each other is arranged on a face of said first insulating substrate, said face being opposite to said second insulating substrate, and a second specified number of data electrodes being positioned in orthogonal to each of said pairs of said scanning electrode and said sustaining electrode is arranged on a face of said second insulating substrate, said face being opposite to said first insulating substrate, display cells each are formed at an intersecting point between each of said pairs of said scanning electrode and sustaining electrode and each of said data electrodes;

a writing unit to sequentially write pixel data corresponding to a video signal to each display cell in said plasma display panel in a scanning period;

a display sustaining unit to sustain displaying of a pixel written by said writing unit by sustaining discharge for a sustaining period; and a potential difference applying unit to apply across said scanning electrode and said sustaining electrode making up said pairs, for a first specified period of time from first specified time after termination of a period during which said scanning pulse is applied to each scanning electrode by said writing unit in said scanning period with different timing, a potential difference being two-thirds or more of a surface firing voltage at which surface discharge occurs between said scanning electrode and said sustaining electrode making up said pairs and being the potential difference at which no discharge is made to be started between said scanning electrode and said sustaining electrode making up said pairs, between said scanning electrode and said sustaining electrode making up said pairs.

14. The driving device for driving an address-display separated-type AC plasma display panel according to claim 13, wherein said first specified time during which said potential difference is applied by said potential difference applying unit is arbitrary time existing between time of termination of a period during which said scanning pulse is applied and time that no formation of wall charges required for said sustaining discharge occur and wherein said first specified period of time is time that can be arbitrarily selected during a period of time from said first specified time to time at which, though formation of wall charges is made to continue by movements of space charges between said scanning electrode and said sustaining electrode making up said pairs, no erroneous discharge occurs.

15. The driving device for driving an address-display separated-type AC plasma display panel according to claim 13, wherein said potential difference applying unit is a sustaining driver which applies a writing wall charge forming pulse, having a polarity reverse to that of said scanning pulse, to said sustaining electrode being paired with said scanning electrode to which said scanning pulse is applied during said period of time from said arbitrary time to generate said potential difference between said scanning electrode and said sustaining electrode making up said pairs.

16. The driving device for driving an address-display separated-type AC plasma display panel according to claim 13, wherein said potential difference applying unit is a sustaining driver which divides said two or more sustaining electrodes into two sustaining electrode groups, applies sequentially and alternately said scanning pulse to said scanning electrode selected from said scanning electrodes being paired with said sustaining electrode making up each of said two sustaining electrode groups and applies alternately a writing wall charge forming pulse, having a polarity reverse to that of said scanning pulse, to each of said sustaining electrodes in said group to which said sustaining electrode being paired with said scanning electrode to which said scanning pulse is applied belongs from time of termination of a period during which said scanning pulse is applied to a period of said first specified period of time in a period of application of said scanning pulse in every group, said potential difference is made to be generated between said scanning electrode and said sustaining electrode making up said pairs.

17. The driving device for driving an address-display separated-type AC plasma display panel according to claim 13, wherein a potential of said scanning pulse to be applied by said writing unit to said scanning electrode is lower by a specified value than a potential occurring in said scanning period other than said period during which said scanning pulse is applied.

18. A driving device for an address-display separated-type AC plasma display panel comprising:

a plasma display panel in which a first insulating substrate and a second insulating substrate are mounted at a specified interval in a manner to oppose to each other, a first specified number of pairs of a scanning electrode and a sustaining electrode being positioned in parallel to each other is arranged on a face of said first insulating substrate, said face being opposite to said second insulating substrate, and a second specified number of data electrodes being positioned in orthogonal to each of said pairs of said scanning electrode and said sustaining electrode is arranged on a face of said second insulating substrate, said face being opposite to said first insulating substrate, display cells are formed at an intersecting point between each of said pairs of said scanning electrode and sustaining electrode and each of said data electrodes;

a writing unit to sequentially write pixel data corresponding to a video signal to each display cell in said plasma display panel during a scanning period; and a display sustaining unit to sustain displaying of a pixel written by said writing unit, by sustaining discharge for a sustaining period; and a potential difference applying unit to apply across said scanning electrode and said sustaining electrode making up said pairs, for a second specified period of time from second specified time before termination of a period during which said scanning pulse is applied to each of said scanning electrodes by said writing unit in said scanning period with different timing, a potential difference being two-thirds or more of a surface firing voltage at which surface discharge occurs between said scanning electrode and said sustaining electrode making up said pairs and being the potential difference at which no discharge is made to be started between said scanning electrode and said sustaining electrode making up said pairs, between said scanning electrode and said sustaining electrode making up said pairs.

19. The driving device for an address-display separated-type AC plasma display panel according to claim 18, wherein said second specified time during which said potential difference applying unit applies said potential difference between said scanning electrode and said sustaining electrode making up said pairs is arbitrary time existing between time after time of termination of a scanning pulse applying period during which no erroneous discharge occurs when said potential difference is applied between said scanning electrode and said sustaining electrode making up said pairs and during which said scanning is applied and time of termination of a period during which said scanning pulse is applied and wherein said second period of time is a period of time that can be arbitrarily selected during a period of time from said second specified time to time at which, though formation of wall charges is made to continue by movements of space charges between said scanning electrode and said sustaining electrode making up said pairs, no erroneous discharge occurs.

20. The driving device for an address-display separated-type AC plasma display panel according to claim 18, wherein said potential difference applying unit is a sustaining driver which applies a writing wall charge forming pulse, having a polarity reverse to that of said scanning pulse, to said sustaining electrode being paired with said scanning electrode to which said scanning pulse is applied during said period of time from said arbitrary time to generate said potential difference between said scanning electrode and said sustaining electrode making up said pairs.

21. The driving device for driving an address-display separated-type AC plasma display panel according to claim 18, wherein a potential of said scanning pulse to be applied by said writing unit to said scanning electrode is lower by a specified value than a potential occurring in said scanning period other than said period during which said scanning pulse is applied.

22. A driving device for an address-display separated-type AC plasma display panel comprising:

a plasma display panel in which a first insulating substrate and a second insulating substrate are mounted at a specified interval in a manner to oppose to each other, a first specified number of pairs of a scanning electrode and a sustaining electrode being positioned in parallel to each other is arranged on a face of said first insulating substrate, said face being opposite to said second insulating substrate, and a second specified number of data electrodes being positioned in orthogonal to each of said pairs of said scanning electrode and said sustaining electrode is arranged on a face of said second insulating substrate, said face being opposite to said first insulating substrate, display cells are formed at an intersecting point between each of said pairs of said scanning electrode and sustaining electrode and each of said data electrodes;

a writing unit to sequentially write pixel data corresponding to a video signal to each display cell in said plasma display panel during a scanning period;

a display sustaining unit to sustain displaying of a pixel written by said writing unit by sustaining discharge for a sustaining period;

a potential difference applying unit to apply across said scanning electrode and said sustaining electrode making up said pairs, for said scanning period during which said scanning pulse is not applied by said writing unit to said scanning electrode, a potential difference being two-thirds or more of a surface firing voltage between said scanning electrode and said sustaining electrode making up said pairs and being the potential difference at which no erroneous discharge occurs between said scanning electrode and said sustaining electrode making up said pairs, between said scanning electrode and said sustaining electrode making up said pairs.

23. The driving device for driving an address-display separated-type AC plasma display panel according to claim 22, wherein said potential difference applying unit is a sustaining driver which applies a sustaining base voltage, having a polarity reverse to that of said scanning pulse, to said sustaining electrode being paired with said scanning electrode in said scanning period during which said scanning pulse is not applied to generate said potential difference between said scanning electrode and said sustaining electrode making up said pairs.

24. The driving device for driving an address-display separated-type AC plasma display panel according to claim 23, wherein said sustaining driver, in said scanning period, after having applied said sustaining base voltage to said sustaining electrode, immediately before said scanning pulse is applied to said scanning electrode, for a period from the time immediately before the application of the scanning pulse to time of termination of said scanning pulse, puts all said sustaining electrodes into a floating state.

25. The driving device for driving an address-display separated-type AC plasma display panel according to claim 24, wherein said sustaining driver, in said scanning period, after having applied said sustaining base voltage to said sustaining electrode, puts all said sustaining electrodes into the floating state and then all said sustaining electrodes are connected through a diode to a port having a specified voltage being lower than that of said sustaining electrode so that said sustaining electrode is operated as a cathode.

26. The driving device for driving an address-display separated-type AC plasma display panel according to claim 22, wherein a potential of said scanning pulse to be applied by said writing unit to said scanning electrode is lower by a specified value than a potential occurring in said scanning period other than said period during which said scanning pulse is applied.

* * * * *